US011391277B2

(12) United States Patent
Tanaka

(10) Patent No.: US 11,391,277 B2
(45) Date of Patent: Jul. 19, 2022

(54) PUMP AND FLUID CONTROL DEVICE

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 6 days.

(21) Appl. No.: 16/924,289

(22) Filed: Jul. 9, 2020

(65) Prior Publication Data

US 2020/0340469 A1 Oct. 29, 2020

Related U.S. Application Data

(63) Continuation of application No. PCT/JP2018/041611, filed on Nov. 9, 2018.

(30) Foreign Application Priority Data

Jan. 10, 2018 (JP) ..... JP2018-001965

(51) Int. Cl.
*F04B 45/10* (2006.01)
*F04B 43/04* (2006.01)
*F04B 45/047* (2006.01)

(52) U.S. Cl.
CPC ..... *F04B 45/10* (2013.01); *F04B 43/046* (2013.01); *F04B 45/047* (2013.01)

(58) Field of Classification Search
CPC .... F04B 43/028; F04B 45/045; F04B 45/041; F04B 43/046; F04B 45/10; F04B 43/14; F04B 39/1033; F04B 53/1035
(Continued)

(56) References Cited

U.S. PATENT DOCUMENTS 5,336,062 A * 8/1994 Richter ..... A61M 5/14586 417/413.2
2009/0087323 A1 4/2009 Blakey et al.
(Continued)

FOREIGN PATENT DOCUMENTS

FR 1434404 A * 4/1966 ..... F16K 15/00
JP H01219369 A 9/1989
(Continued)

OTHER PUBLICATIONS

Machine Translation of French Patent FR 1434404 A retreived from espacenet on Mar. 19, 2022 (Year: 2022).*
(Continued)

*Primary Examiner* — Essama Omgba
*Assistant Examiner* — Dnyanesh G Kasture
(74) *Attorney, Agent, or Firm* — Pearne & Gordon LLP

(57) ABSTRACT

A pump includes a first pump chamber formed by a first plate member and a second plate member, a second pump chamber formed by a first plate member and a third plate member, and a driving member. The driving member causes the first plate member to perform flexural vibration, thereby causing pressure changes in both of the first pump chamber and the second pump chamber. The first plate member is provided with first hole portions not overlapping an axial line orthogonal to a central region of the first plate member, and a check valve is provided to each of the first hole portions. The second plate member and the third plate member are provided with a second hole portion and a third hole portion respectively, and the check valve is provided to at least one of the second hole portion and the third hole portion.

25 Claims, 11 Drawing Sheets

(58) Field of Classification Search
USPC ..... 417/413.1–413.3; 137/856
See application file for complete search history.

(56) References Cited

U.S. PATENT DOCUMENTS

| | | | | |
|---|---|---|---|---|
| 2009/0188576 | A1* | 7/2009 | Kang | F04B 43/046 137/831 |
| 2010/0074775 | A1* | 3/2010 | Yamamoto | F04B 43/046 417/413.2 |
| 2011/0280755 | A1 | 11/2011 | Wackerle et al. | |
| 2013/0236338 | A1* | 9/2013 | Locke | F04B 43/046 417/413.1 |
| 2013/0280105 | A1* | 10/2013 | Locke | F04B 43/0054 417/53 |
| 2016/0348666 | A1* | 12/2016 | Tanaka | F04D 33/00 |
| 2017/0152845 | A1* | 6/2017 | Sasaki | F04D 33/00 |

FOREIGN PATENT DOCUMENTS

| | | | |
|---|---|---|---|
| JP | 2007092677 | A | 4/2007 |
| JP | 2008537057 | A | 9/2008 |
| JP | 2010230015 | A | 10/2010 |
| WO | 2016013390 | A1 | 1/2016 |

OTHER PUBLICATIONS

International Search Report issued in Application No. PCT/JP2018/041611, dated Jan. 29, 2019.
Written Opinion issued in Application No. PCT/JP2018/041611, dated Jan. 29, 2019.

* cited by examiner

PUMP AND FLUID CONTROL DEVICE

This is a continuation of International Application No. PCT/JP2018/041611 filed on Nov. 9, 2018 which claims priority from Japanese Patent Application No. 2018-001965 filed on Jan. 10, 2018. The contents of these applications are incorporated herein by reference in their entireties.

BACKGROUND OF THE DISCLOSURE

Field of the Disclosure

The present disclosure relates to a positive displacement pump using flexural vibration of a diaphragm and a fluid control device including the same, and more particularly to a piezoelectric pump using a piezoelectric element as a driving member for driving the diaphragm and a fluid control device including the same.

Description of the Related Art

A piezoelectric pump which is a type of a positive displacement pump has been known. In a piezoelectric pump, at least part of a pump chamber is formed by a diaphragm to which a piezoelectric element is attached, and an AC voltage having a predetermined frequency is applied to the piezoelectric element to drive the diaphragm at a resonant frequency, thereby causing pressure change in the pump chamber to enable a fluid to be suctioned and discharged.

An example of configuration of a piezoelectric pump is disclosed in International Publication No. 2016-013390 (Patent Document 1), for example. In the piezoelectric pump disclosed in Patent Document 1, a pump chamber is formed by diaphragms disposed facing each other and constituting a pair, and a piezoelectric element is attached to one of the diaphragms constituting the pair.

In the piezoelectric pump disclosed in Patent Document 1, in the diaphragms constituting the pair, provided is one hole portion to which a check valve is provided in a central region of the diaphragm without the piezoelectric element attached thereto, and provided are hole portions arranged in an annular shape with an interval therebetween in an intermediate region excluding a central region and a peripheral region of the other diaphragm with the piezoelectric element attached thereto.

In an embodiment of the piezoelectric pump disclosed in Patent Document 1, the check valve is provided to each of the hole portions arranged in an annular shape with an interval therebetween, and in another embodiment of the piezoelectric pump, the check valve is not provided to each of the hole portions.

In the piezoelectric pump according to any one of the embodiments described above, a pump function is achieved as follows. The diaphragms constituting the pair are caused to perform flexural vibration to be displaced in opposite directions by a piezoelectric element and pressure changes thus occur in a pump chamber. Due to the pressure changes in the pump chamber, fluid positioned outside the pump chamber is suctioned through hole portions provided to the diaphragm with the piezoelectric element attached thereto, and then the fluid is discharged through one hole portion provided to the diaphragm without the piezoelectric element attached thereto.

Patent Document 1: International Publication No. 2016-013390

BRIEF SUMMARY OF THE DISCLOSURE

Here, in the hole portion to which the check valve is provided, a flow path resistance becomes larger as the flow path becomes narrower than the hole portion to which the check valve is not provided. Therefore, as in the piezoelectric pump disclosed in Patent Document 1, when the hole portion with the check valve is provided in the central region of the diaphragm, an overall flow rate of the piezoelectric pump is determined by the hole portion, and therefore there arises a limitation in increasing the flow rate.

In a configuration in which the hole portions with the check valve are simply provided in the intermediate region excluding the central region and the peripheral region of the diaphragm in order to avoid the problem above, the flow path resistance is greatly reduced. However, an amount of displacement of the diaphragm in motion in the intermediate region is smaller than that in the central region, and therefore there arises a problem that an action of opening and closing of the check valve is not sufficient. Therefore, when the configuration above is adopted, also, it is difficult to increase the overall flow rate of the piezoelectric pump.

The present disclosure has been made in light of the aforementioned problem, and it is an object of the present disclosure to increase a flow rate in a positive displacement pump using flexural vibration of a diaphragm and in a fluid control device including the same, in comparison with the related art.

A pump according to the present disclosure includes a first plate member, a second plate member, a third plate member, a first circumferential wall member, a second circumferential wall member, a first pump chamber, a second pump chamber, and a driving member. The second plate member faces the first plate member. The third plate member is positioned on a side opposite from a side where the second plate member is positioned when viewed from the first plate member, and the third plate member faces the first plate member. The first circumferential wall member connects the peripheral region of the first plate member and the peripheral region of the second plate member. The second circumferential wall member connects the peripheral region of the first plate member and the peripheral region of the third plate member. The first pump chamber is positioned between the first plate member and the second plate member, and is formed by the first plate member, the second plate member and the first circumferential wall member. The second pump chamber is positioned between the first plate member and the third plate member, and is formed by the first plate member, the third plate member and the second circumferential wall member. The driving member causes a pressure change in both of the first pump chamber and the second pump chamber by causing the first plate member to perform flexural vibration. The first plate member is provided with two or more first hole portions to which a check valve is provided respectively, and each of the two or more first hole portions is arranged in a region not overlapping an axial line when viewed in an extending direction of the axial line orthogonal to a central region of the first plate member. In the second plate member, one or two or more second hole portions are provided, and in the third plate member, one or two or more third hole portions are provided. A check valve is provided to at least either of the one or the two or more second hole portions, or the one or the two or more third hole portions.

In the pump according to the present disclosure, the driving member may cause the first plate member to perform flexural vibration so that a standing wave is generated in the first plate member around the axial line and an antinode of vibration is formed in the central region of the first plate member. In this case, it is preferable that each of the two or more first hole portions be arranged in a region not overlapping a node of vibration formed in the first plate member.

In the pump according to the present disclosure, it is preferable that the two or more first hole portions be arranged with an interval therebetween in a position on a circumference around the axial line when viewed in the extending direction of the axial line.

In the pump according to the present disclosure, it is preferable that a distance between adjacent first hole portions among the two or more first hole portions be smaller than a distance between the axial line and each of the two or more first hole portions.

In the pump according to the present disclosure, the first plate member may be caused to perform flexural vibration by the driving member such that an antinode of vibration is further formed at a position excluding the central region of the first plate member.

In the pump according to the present disclosure, it is preferable that at least one of the two or more first hole portions be arranged in a region overlapping the antinode of vibration formed at a position excluding the central region of the first plate member.

In the pump according to the present disclosure, it is more preferable that each of the two or more first hole portions be arranged in the region overlapping the antinode of vibration formed at the position excluding the central region of the first plate member.

In the pump according to the present disclosure, each of the two or more first hole portions may be arranged in a region outside a node of vibration formed at a position farthest from the central region of the first plate member among nodes of vibration formed in a region excluding the peripheral region of the first plate member.

In the pump according to the present disclosure, when a check valve is attached to the one or the two or more second hole portions, it is preferable that the one or the two or more second hole portions be arranged in a region not overlapping the node of vibration formed in the first plate member when viewed in the extending direction of the axial line.

In the pump according to the present disclosure, when the check valve is provided to the one or the two or more second hole portions, it is more preferable that the one or the two or more second hole portions be arranged in a region overlapping the antinode of vibration formed at a position excluding the central region of the first plate member when viewed in the extending direction of the axial line.

In the pump according to the present disclosure, when the check valve is provided to the one or the two or more third hole portions, it is preferable that the one or the two or more third hole portions be arranged in a region not overlapping the node of vibration formed in the first plate member when viewed in the extending direction of the axial line.

In the pump according to the present disclosure, when the check valve is provide to the one or the two or more third hole portions, it is more preferable that the one or the two or more third hole portions be arranged in a region overlapping the antinode of vibration formed at a position excluding the central region of the first plate member when viewed in the extending direction of the axial line.

In a first aspect and a second aspect of the pump according to the present disclosure, the driving member causes the first plate member to perform flexural vibration such that a standing wave is generated in the first plate member around the axial line and an antinode of vibration is formed in the central region of the first plate member, each of the two or more first hole portions is arranged in a region not overlapping a node of vibration formed in the first plate member, and the two or more second hole portions are provided and the check valve is provided to each of the two or more second hole portions. The two or more first hole portions are arranged with an interval therebetween in a position on a circumference around the axial line when viewed in the extending direction of the axial line, and the two or more second hole portions are arranged with an interval therebetween in a position on a circumference around the axial line when viewed in the extending direction of the axial line.

In the first aspect, the first plate member may be caused to perform flexural vibration by the driving member such that an antinode of vibration is further formed at a position excluding the central region of the first plate member. In this case, it is preferable that the two or more second hole portions be arranged in a region not overlapping the node of vibration formed in the first plate member when viewed in the extending direction of the axial line.

In the first aspect, it is more preferable that each of the two or more first hole portions be arranged in a region overlapping the antinode of vibration formed at the position excluding the central region of the first plate member. Further, it is more preferable that each of the two or more second hole portions be arranged in a region overlapping the antinode of vibration formed in the first plate member when viewed in the extending direction of the axial line.

In the first aspect, it is preferable that the total number of the two or more second hole portions be smaller than the total number of the two or more first hole portions.

In the second aspect, the two or more third hole portions are provided, and the check valve is provided to each of the two or more third hole portions. The two or more third hole portions are arranged with an interval therebetween in a position on a circumference around the axial line when viewed in the extending direction of the axial line.

In the second aspect, the first plate member may be caused to perform flexural vibration by the driving member such that the antinode of vibration is further formed at a position excluding the central region of the first plate member. In this case, it is preferable that the two or more second hole portions be arranged in a region not overlapping the node of vibration formed in the first plate member when viewed in the extending direction of the axial line, and it is preferable that the two or more third hole portions be arranged in a region not overlapping the node of vibration formed in the first plate member when viewed in the extending direction of the axial line.

In the second aspect, it is more preferable that each of the two or more first hole portions be arranged in a region overlapping the antinode of vibration formed at the position excluding the central region of the first plate member. Further, it is more preferable that each of the two or more second hole portions be arranged in a region overlapping the antinode of vibration formed in the first plate member when viewed in the extending direction of the axial line, and it is more preferable that each of the two or more third hole portions be arranged in a region overlapping the antinode of vibration formed in the first plate member when viewed in the extending direction of the axial line.

In the second aspect, it is preferable that the total number of the two or more second hole portions be smaller than the total number of the two or more first hole portions, and that the total number of the two or more third hole portions be smaller than the total number of the two or more first hole portions.

In the first aspect and the second aspect, the driving member may cause the second plate member to perform flexural vibration such that a standing wave is generated in the second plate member around the axial line and the antinode of vibration is formed in the central region of the second plate member, and the driving member also may cause the third plate member to perform flexural vibration such that a standing wave is generated in the third plate member around the axial line and an antinode of vibration is formed in a central region of the third plate member.

In the pump according to the present disclosure, it is preferable that a hole other than the two or more first hole portions, the one or the two or more second hole portions, and the one or the two or more third hole portions be not provided in any of the first plate member, the second plate member, the third plate member, the first circumferential wall member, and the second circumferential wall member.

In the pump according to the present disclosure, the driving member may include a piezoelectric element having a substantially flat plate shape, and in this case, it is preferable that the piezoelectric element be attached to the central region of the first plate member.

In the pump according to the present disclosure, it is preferable that any of each of the two or more first hole portions be arranged outside relative to the piezoelectric element when viewed in the extending direction of the axial line.

The fluid control device according to the present disclosure is provided with the pump according to the present disclosure.

According to the present disclosure, in the positive displacement pump using flexural vibration of a diaphragm and the fluid control device including the same, an increase in the flow rate can be achieved in comparison with the related art.

Figure 1:
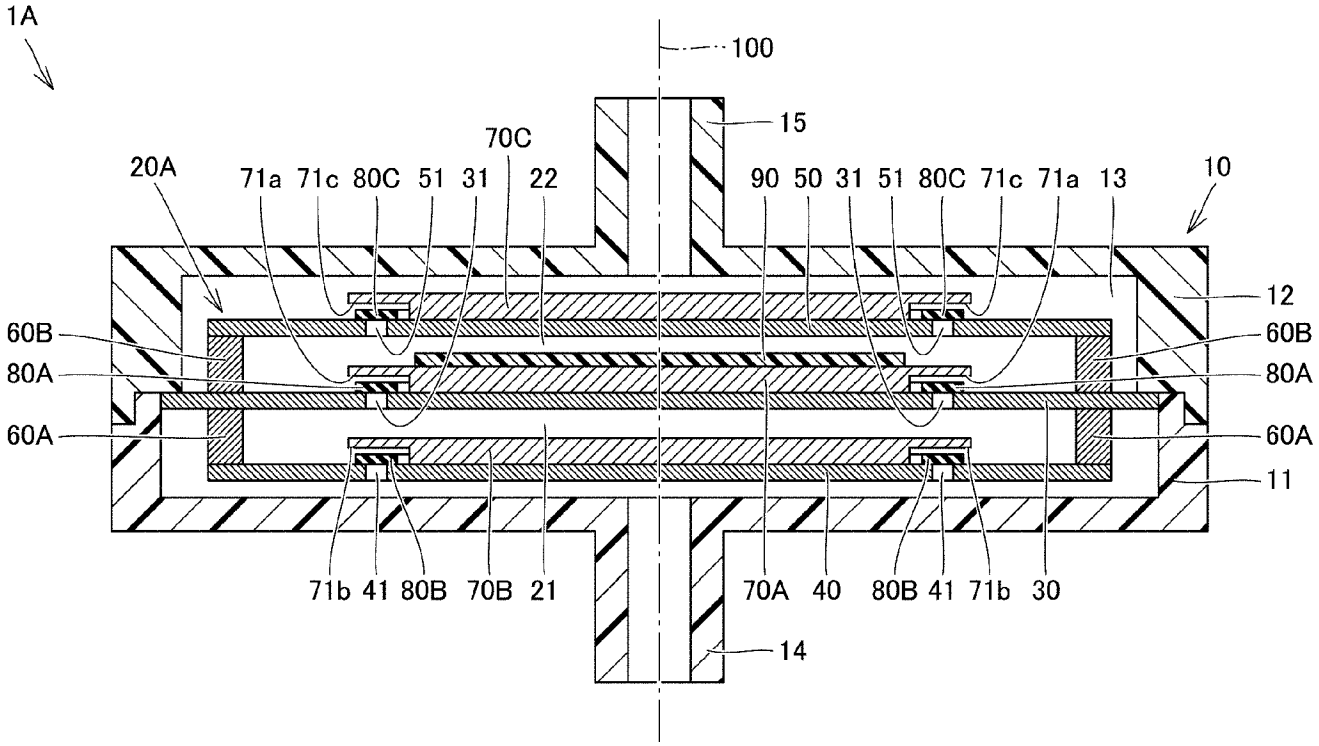
FIG. 1 is a schematic sectional view of a piezoelectric blower according to Embodiment 1.
Figure 3A:
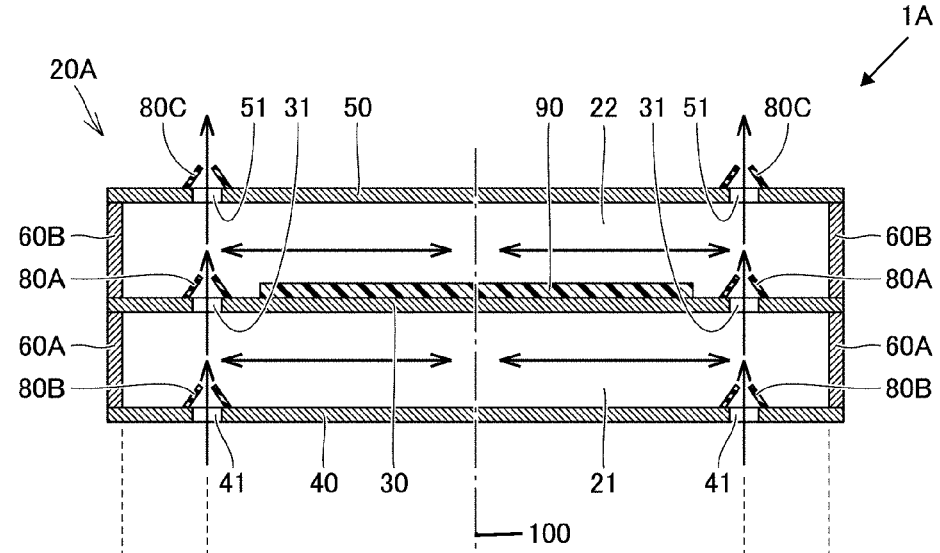
Figure 3B:
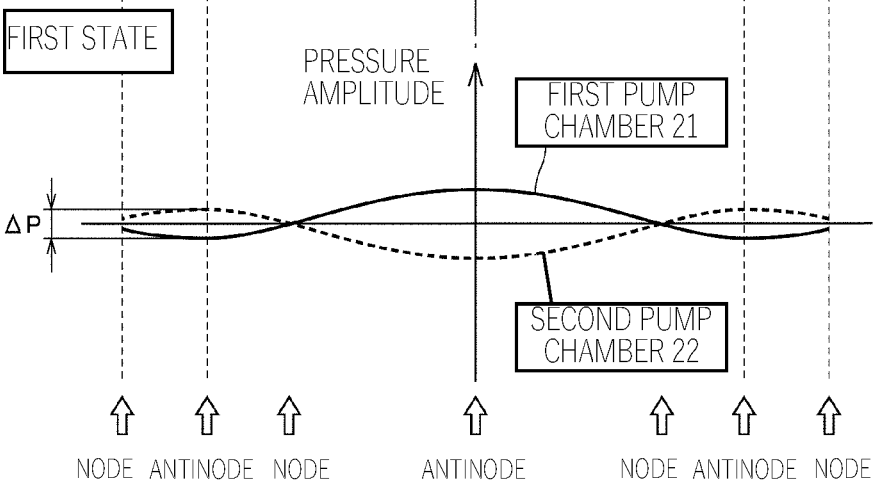
Figure 3C:
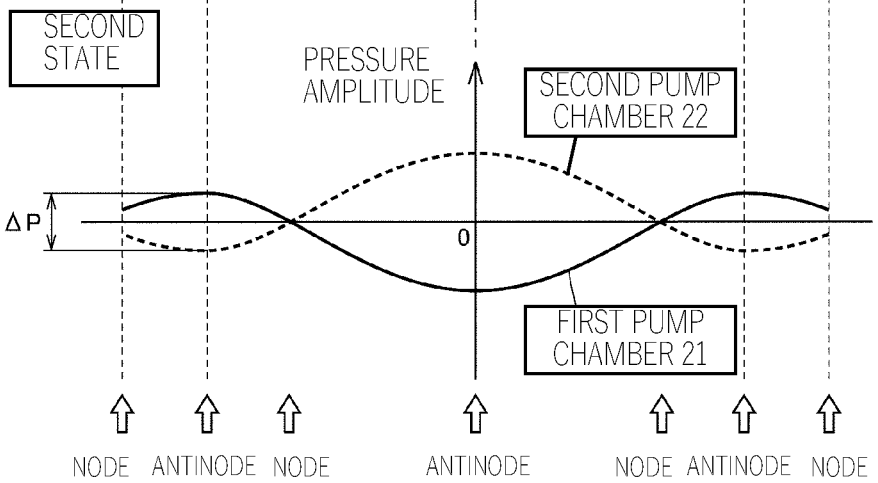

Each of FIGS. 3A, 3B and 3C is a schematic diagram describing a configuration of a driving unit in the piezoelectric blower illustrated in FIG. 1, an approximate direction of a gas flow generated during operation, and a pressure change generated in a first pump chamber and a second pump chamber.

Figure 4A:
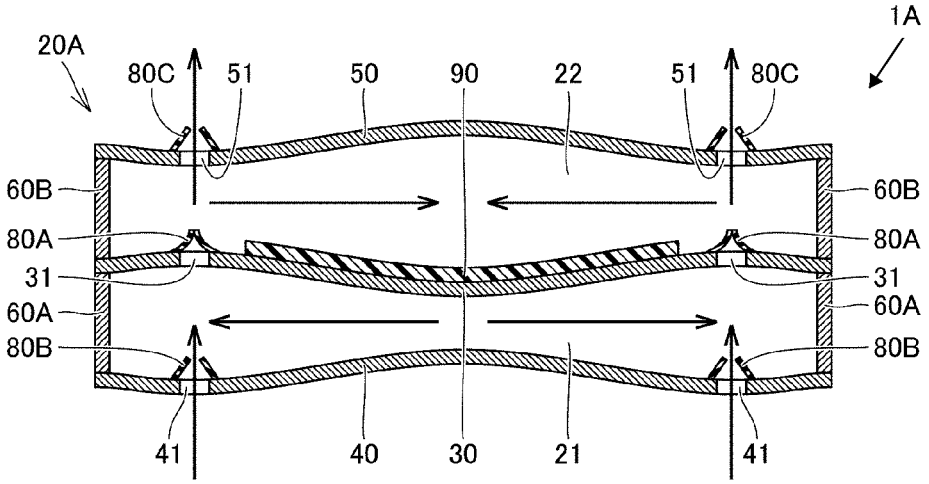
Figure 4B:
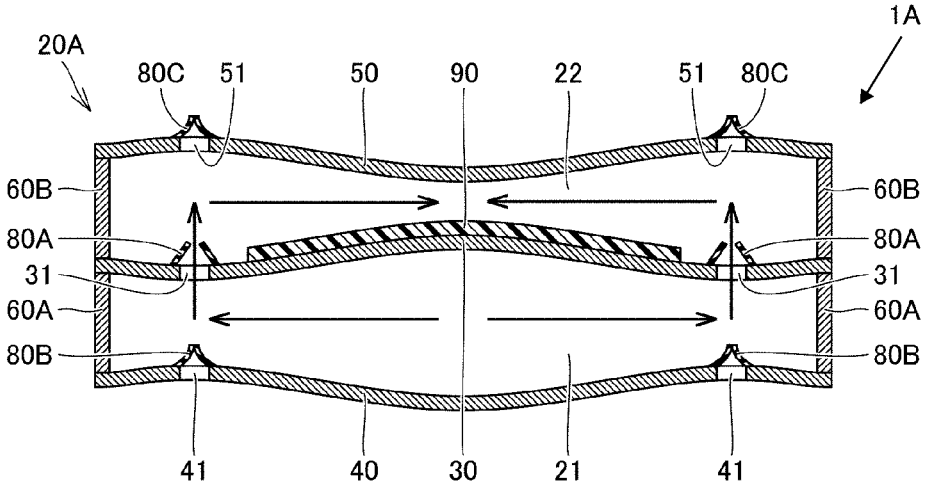

Each of FIGS. 4A and 4B is a schematic diagram describing an operation status of the driving unit in the piezoelectric blower illustrated in FIG. 1 and the direction of the gas flow generated in each status over time.

Figure 5:
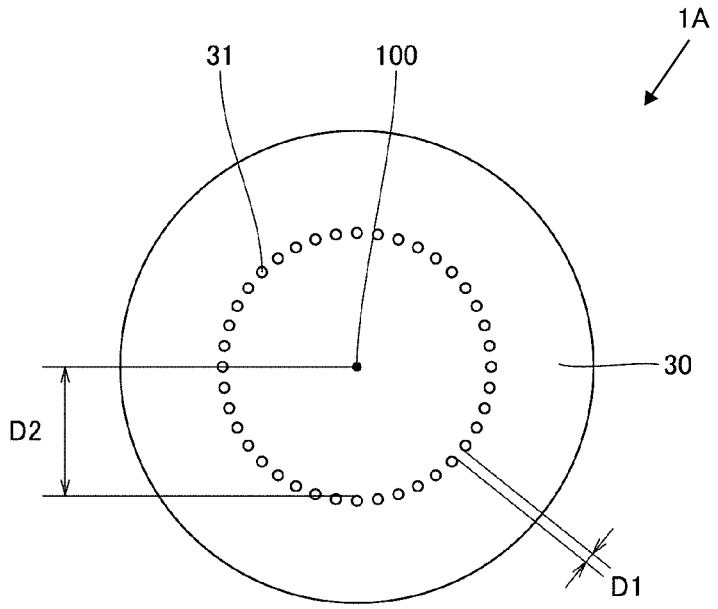

FIG. 5 is a plan view of a first diaphragm illustrated in FIG. 1.

Figure 6:
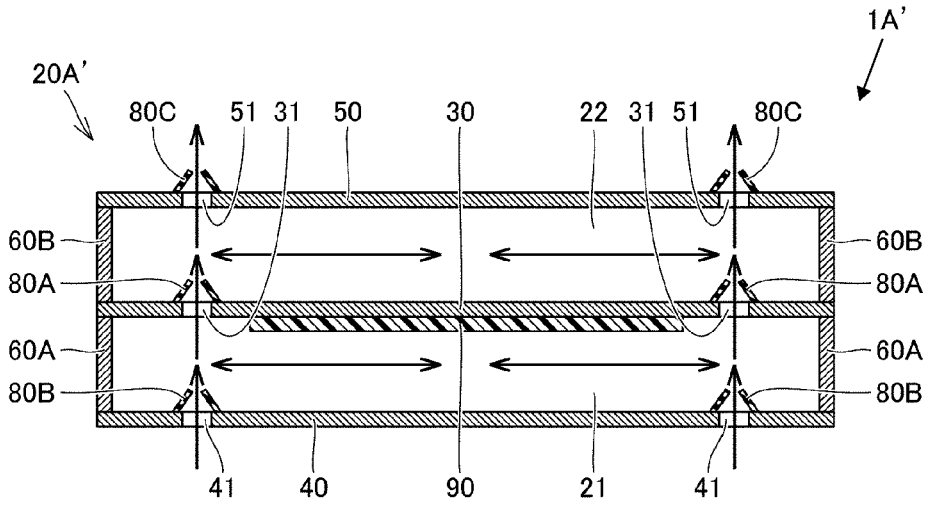

FIG. 6 is a schematic diagram describing a configuration of a driving unit in a piezoelectric blower and an approximate direction of a gas flow generated during operation according to Modification 1.

Figure 7:
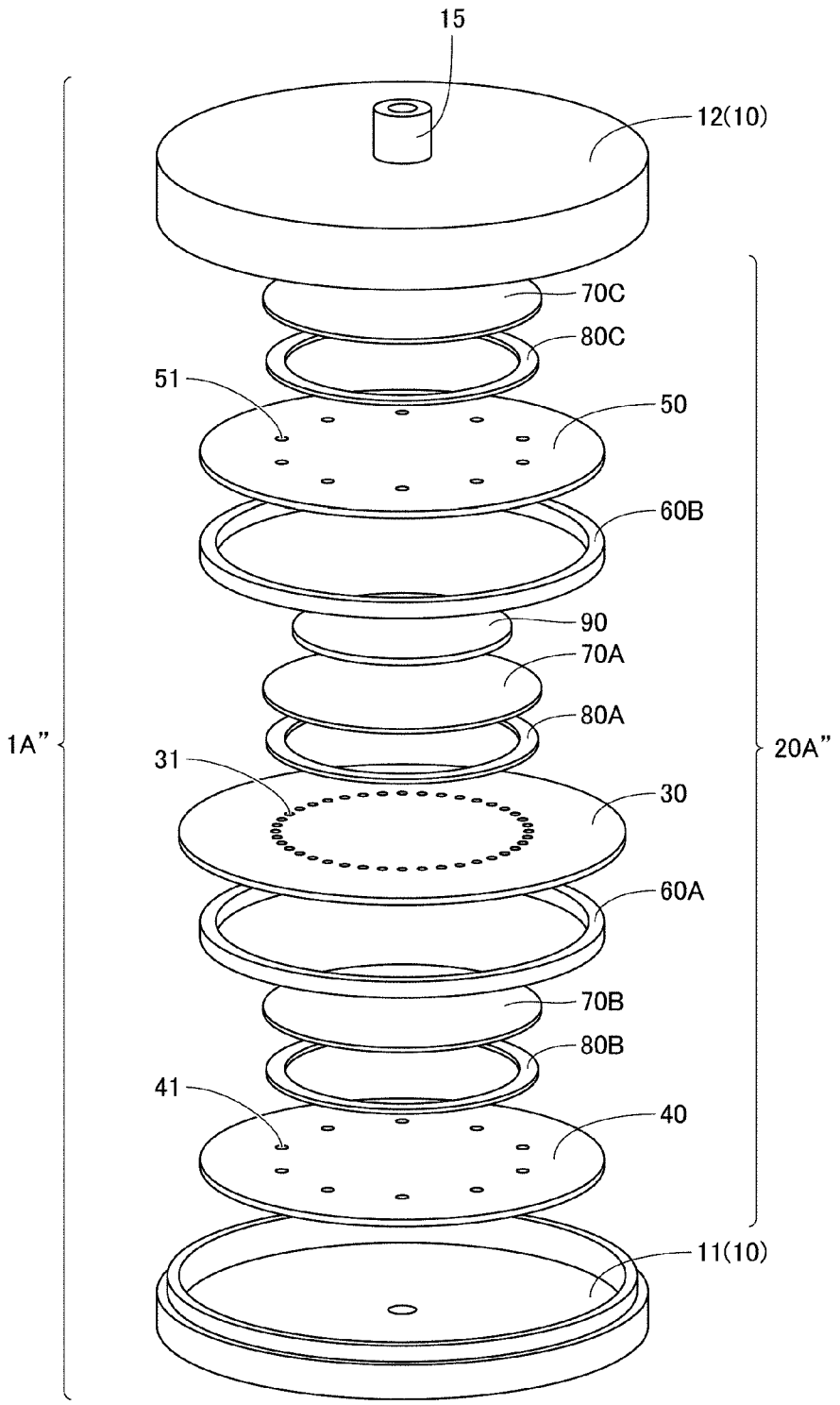

FIG. 7 is an exploded perspective view of a piezoelectric blower according to Modification 2.

Figure 8A:
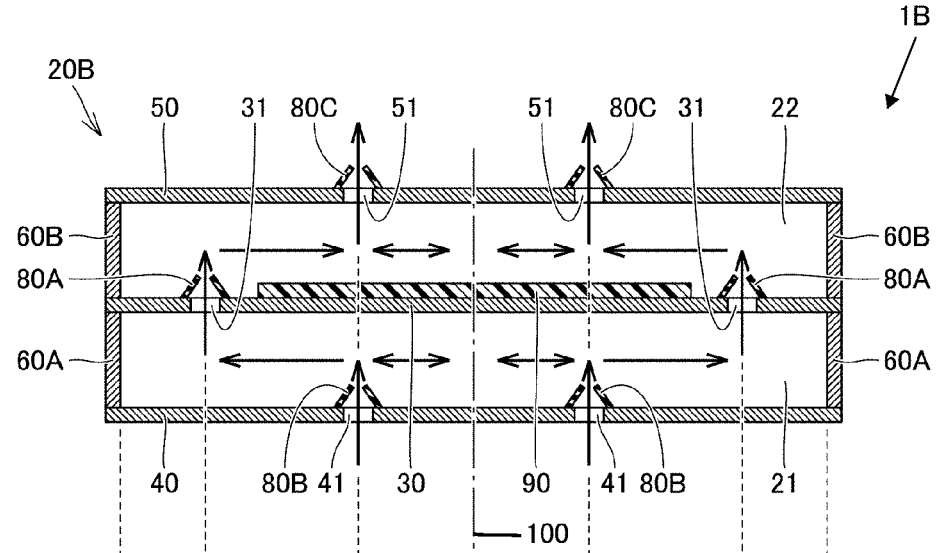
Figure 8B:
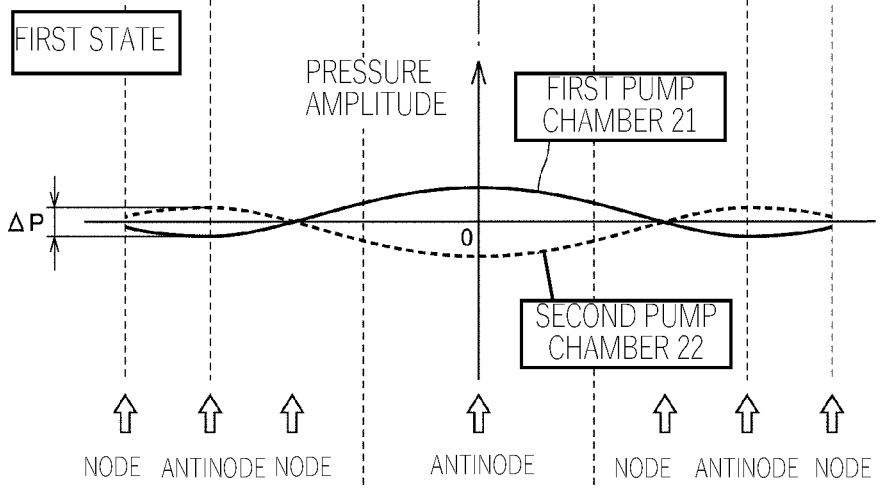
Figure 8C:
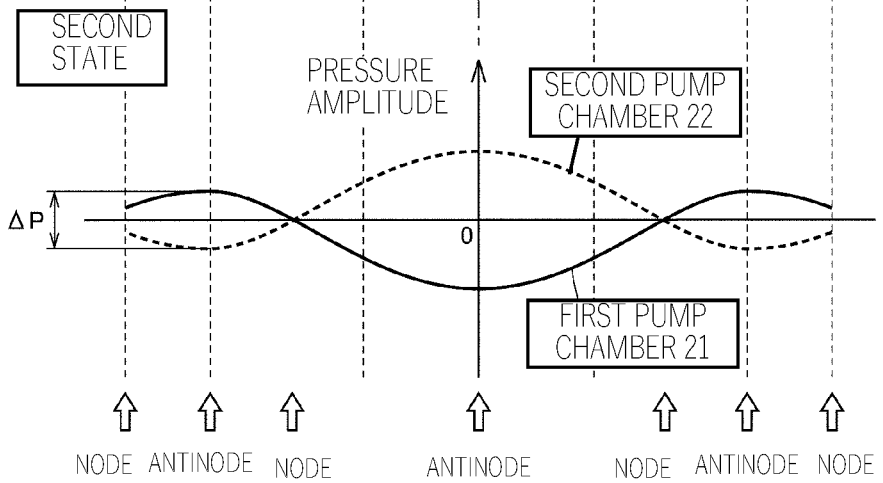

Each of FIGS. 8A, 8B and 8C is a schematic diagram describing a configuration of a driving unit in a piezoelectric blower, an approximate direction of a gas flow generated during operation, and a pressure change generated in a first pump chamber and a second pump chamber according to Embodiment 2.

Figure 9A:
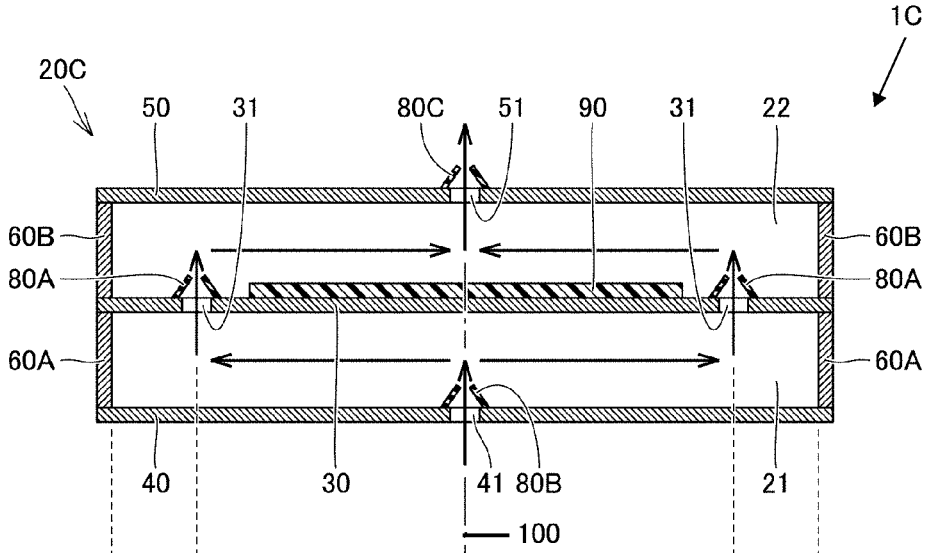
Figure 9B:
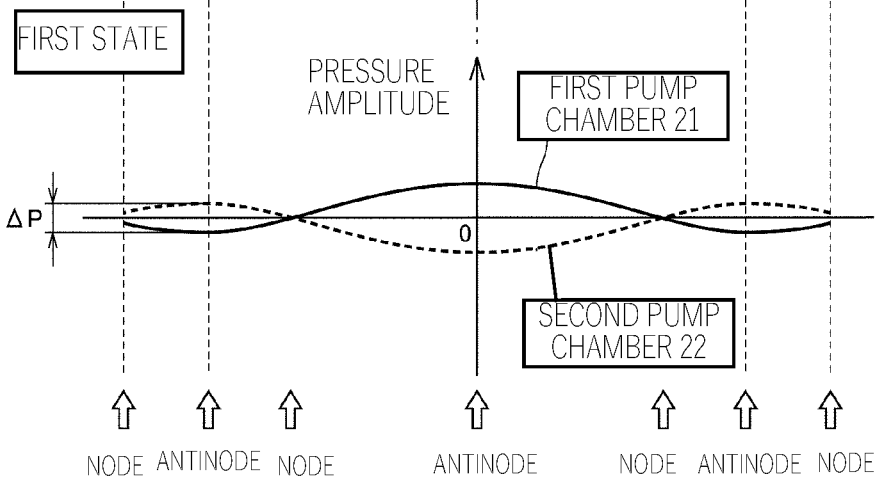
Figure 9C:
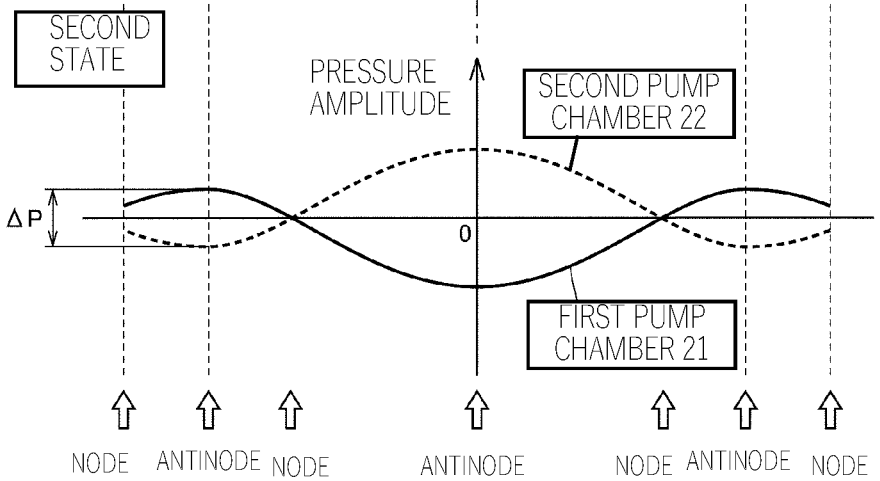

Each of FIGS. 9A, 9B and 9C is a schematic diagram describing a configuration of a driving unit in a piezoelectric blower, an approximate direction of a gas flow generated during operation, and a pressure change generated in a first pump chamber and a second pump chamber according to Embodiment 3.

Figure 10A:
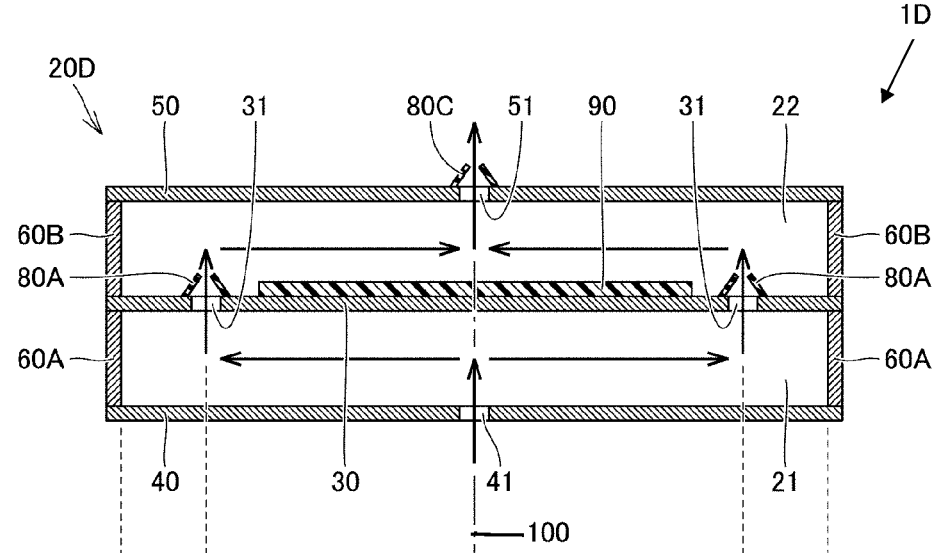
Figure 10B:
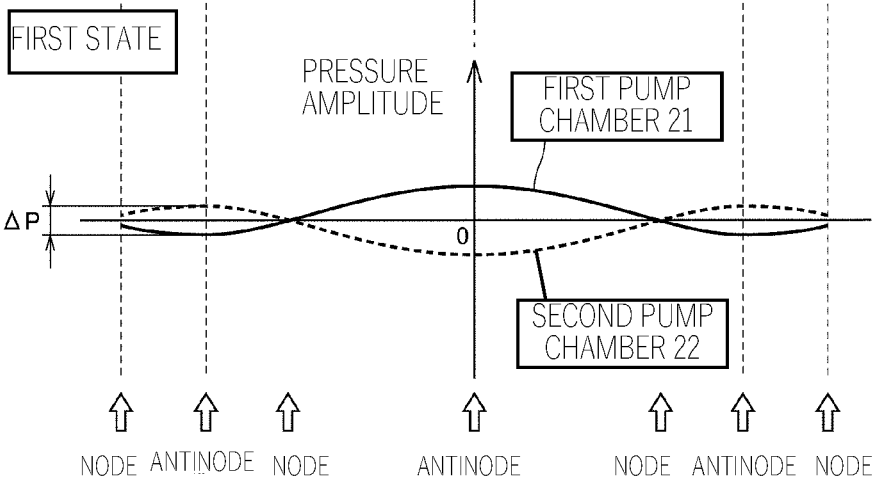
Figure 10C:
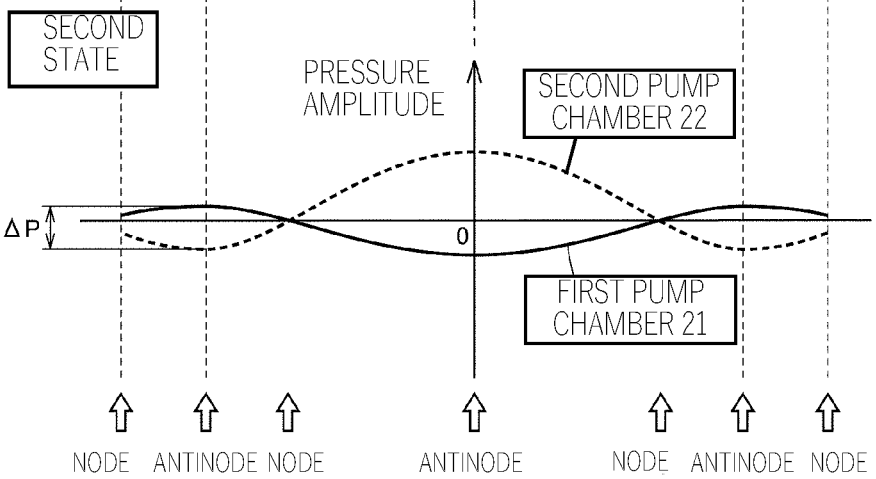

Each of FIGS. 10A, 10B and 10C is a schematic diagram describing a configuration of a driving unit in a piezoelectric blower, an approximate direction of a gas flow generated during operation, and a pressure change generated in a first pump chamber and a second pump chamber according to Embodiment 4.

Figure 11A:
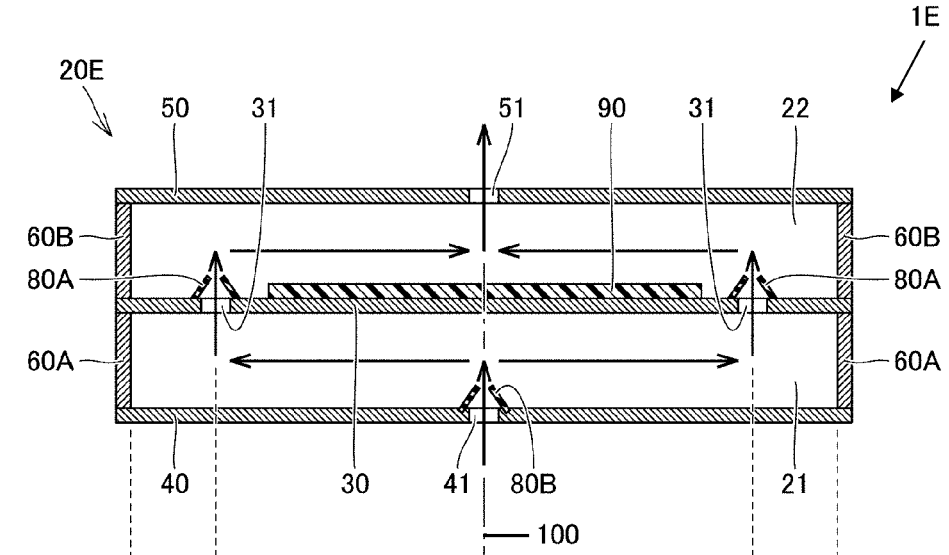
Figure 11B:
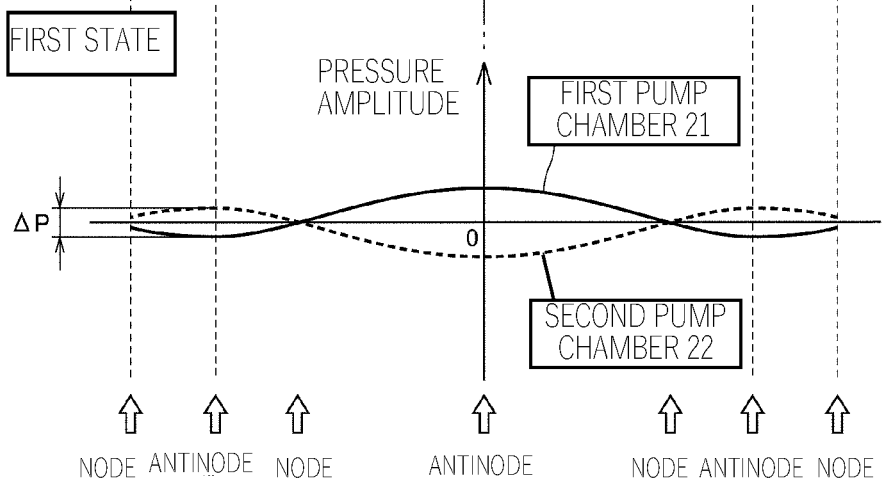
Figure 11C:
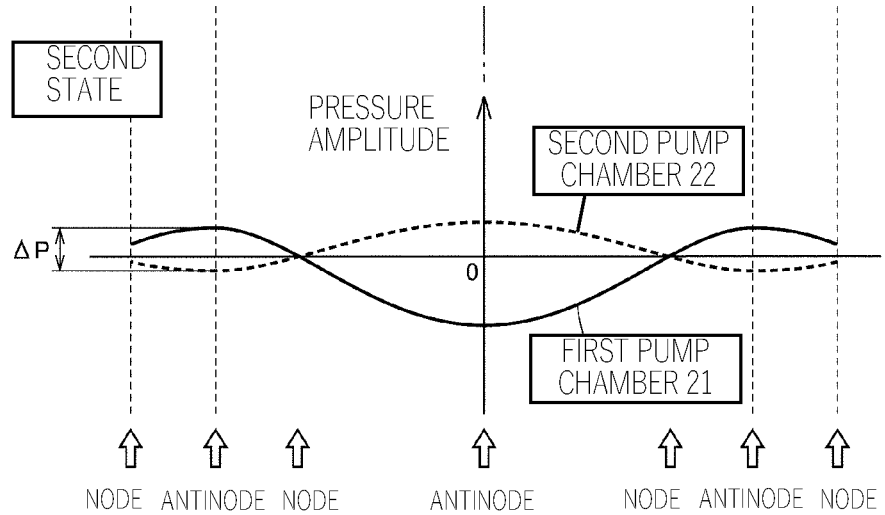

Each of FIGS. 11A, 11B and 11C is a schematic diagram describing a configuration of a driving unit in a piezoelectric blower, an approximate direction of a gas flow generated during operation, and a pressure change generated in a first pump chamber and a second pump chamber according to Embodiment 5.

Figure 12A:
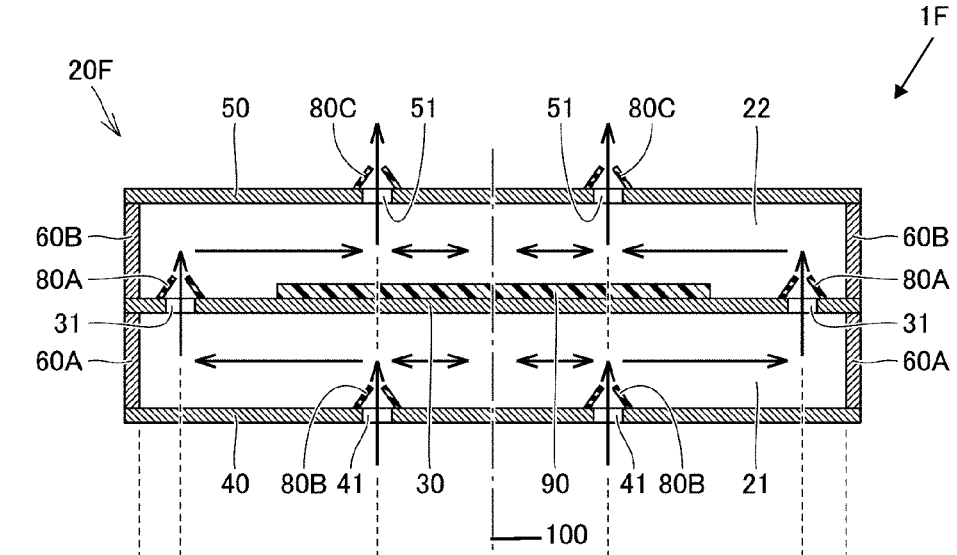
Figure 12B:
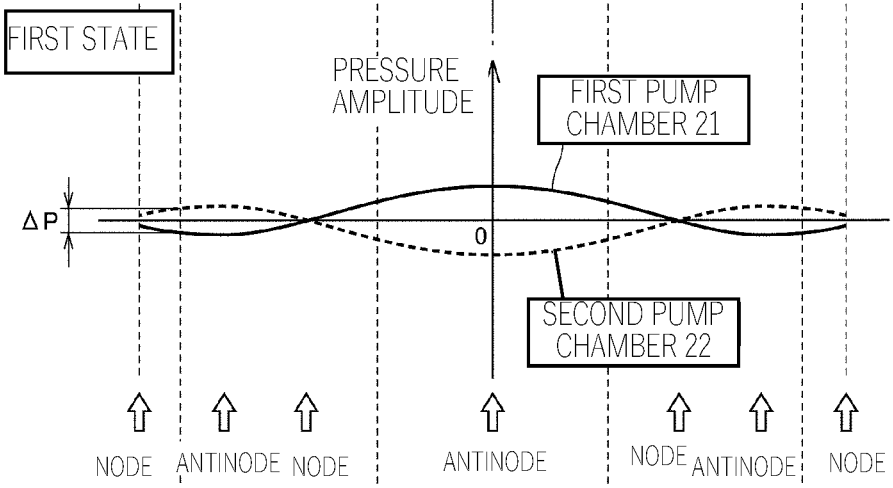
Figure 12C:
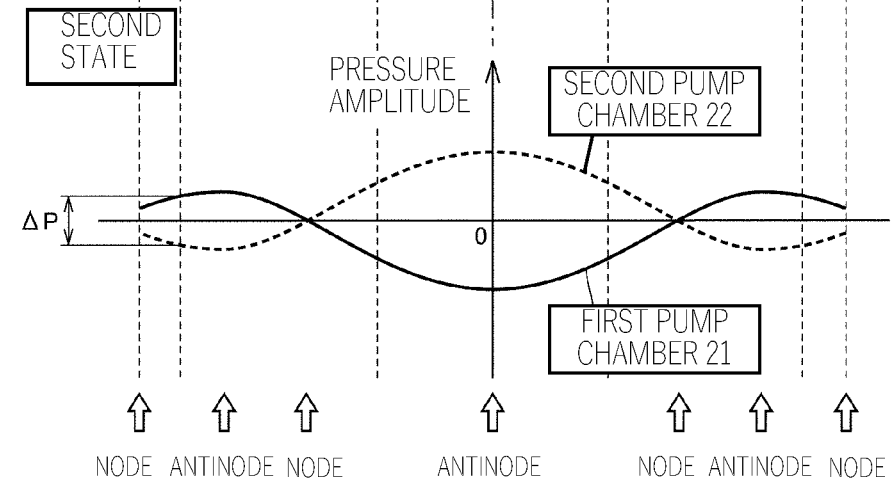

Each of FIGS. 12A, 12B and 12C is a schematic diagram describing a configuration of a driving unit in a piezoelectric blower, an approximate direction of a gas flow generated during operation, and a pressure change generated in a first pump chamber and a second pump chamber according to Embodiment 6.

DETAILED DESCRIPTION OF THE DISCLOSURE

Hereinafter, embodiments of the present disclosure will be described in detail with reference to the drawings. The following embodiments exemplify a case where the present disclosure is applied to a piezoelectric blower as a pump for suctioning and discharging of gas. In the following embodiments, the same or common portions are denoted by the same reference numerals, and the description thereof will not be repeated.

Embodiment 1

Figure 2:
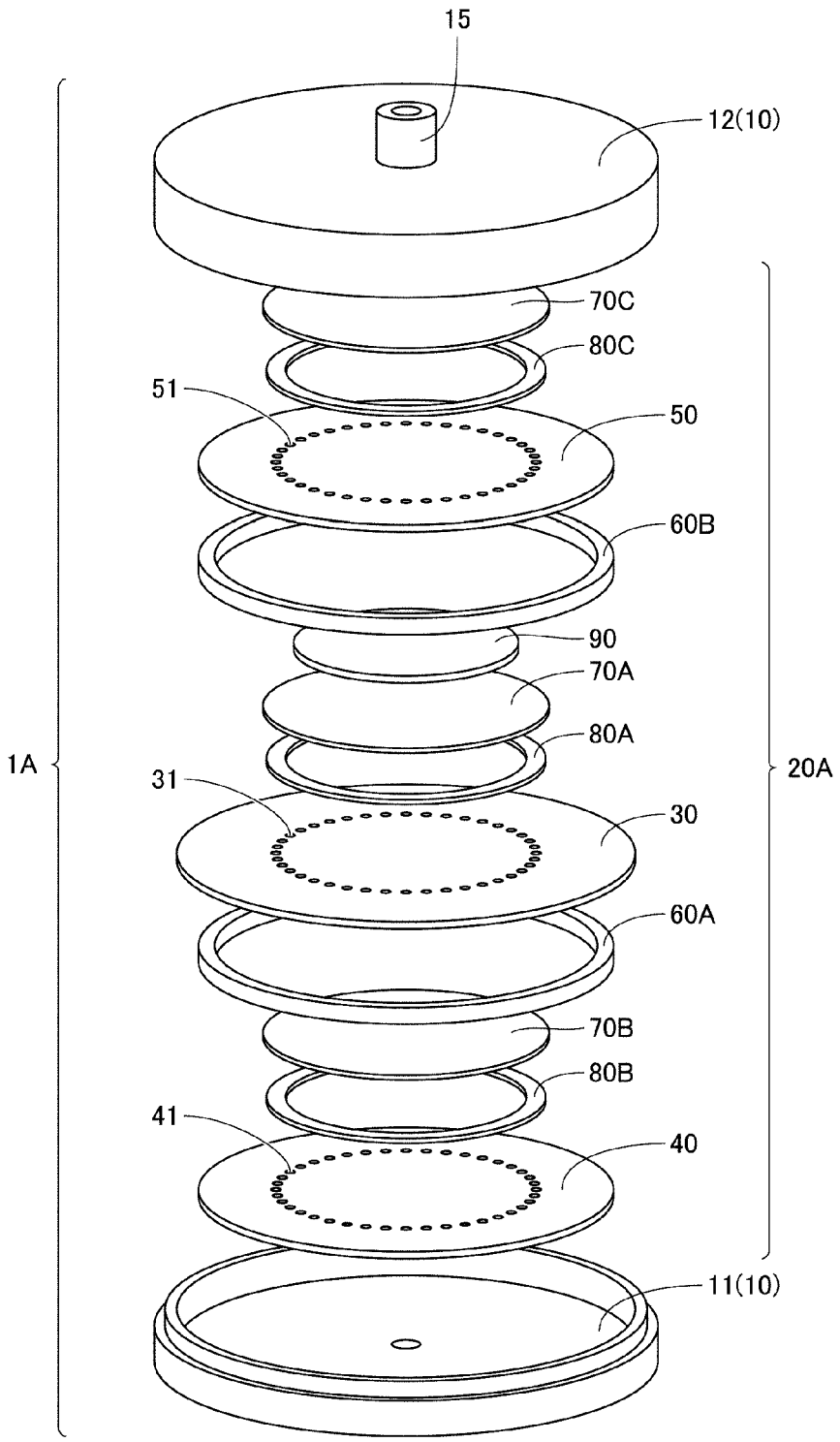
FIG. 2 is an exploded perspective view of the piezoelectric blower illustrated in FIG. 1.

FIG. 1 is a schematic sectional view of a piezoelectric blower according to Embodiment 1 of the present disclosure, and FIG. 2 is an exploded perspective view of the piezoelectric blower illustrated in FIG. 1. First, the configuration of a piezoelectric blower 1A according to the present embodiment will be described with reference to FIG. 1 and FIG. 2.

As illustrated in FIG. 1 and FIG. 2, the piezoelectric blower 1A according to the present embodiment mainly includes a case 10 and a driving unit 20A. A housing space 13, which is a flat substantially cylindrical space, is provided inside the case 10, and the driving unit 20A is disposed therein.

The case 10 has a disk shaped first case member 11 made of resin, metal or the like, and a bottomed substantially cylindrical shaped second case member 12 made of resin or metal. The first case member 11 and the second case member 12 are combined and bonded to each other by such as an adhesive or the like to make the case 10, and the case 10 includes the housing space 13 therein.

In a central region of the first case member 11 and in a central region of the second case member 12, a first nozzle portion 14 and a second nozzle portion 15 projecting outward are provided, respectively. A space outside the piezoelectric blower 1A and the housing space 13 communicate with each other through the first nozzle portion 14 and the second nozzle portion 15.

The driving unit 20A mainly includes a first diaphragm 30 as a first plate member, a second diaphragm 40 as a second plate member, a third diaphragm 50 as a third plate member, a first spacer 60A as a first circumferential wall member, a second spacer 60B as a second circumferential wall member, a first valve supporting member 70A, a second valve supporting member 70B, a third valve supporting member 70C, a first check valve 80A, a second check valve 80B, a third check valve 80C, and a piezoelectric element 90 as a driving member. The driving unit 20A is configured by integrating the members described above in a state in which the members of the driving unit 20A are stacked one another, disposed in the housing space 13 of the case 10, and supported by the case 10. The housing space 13 of the case 10 is partitioned into a space on the first nozzle portion 14 side and a space on the second nozzle portion 15 side by the driving unit 20A.

The first diaphragm 30 is formed of a metal thin plate made of such as stainless steel or the like, and has a substantially circular outer shape in a plan view. The outermost end of a peripheral region of the first diaphragm 30 is bonded to the case 10 by such as an adhesive or the like. First hole portions 31 are arranged in an annular shape with an interval therebetween in an intermediate region excluding the central region and the peripheral region of the first diaphragm 30.

The second diaphragm 40 faces the first diaphragm 30, and more specifically, is disposed on a side where the first case member 11 is positioned when viewed from the first diaphragm 30. The second diaphragm 40 is formed of a metal thin plate made of such as stainless steel or the like, and has a substantially circular outer shape in a plan view. Second hole portions 41 are arranged in an annular shape with an interval therebetween in the intermediate region excluding the central region and the peripheral region of the second diaphragm 40.

The third diaphragm 50 faces the first diaphragm 30, and more specifically, is disposed on a side where the second case member 12 is positioned when viewed from the first diaphragm 30 (that is, opposite to the side where the second diaphragm 40 is positioned when viewed from the first diaphragm 30). The third diaphragm 50 is formed of a metal thin plate made of such as stainless steel or the like, and has a substantially circular outer shape in a plan view. Third hole portions 51 are arranged in an annular shape with an interval therebetween in the intermediate region excluding the central region and the peripheral region of the third diaphragm 50.

The first spacer 60A is positioned between the first diaphragm 30 and the second diaphragm 40, and is sandwiched by the first diaphragm 30 and the second diaphragm 40. The first spacer 60A is formed of a metal member made of such as stainless steel or the like, and has a substantially annular plate outer shape.

The first spacer 60A connects the peripheral region excluding the outermost end of the first diaphragm 30 and the peripheral region of the second diaphragm 40. Thus, the first diaphragm 30 and the second diaphragm 40 are placed with a predetermined distance determined by the first spacer 60A. The first spacer 60A and the first diaphragm 30 are bonded by such as an adhesive or the like, and the first spacer 60A and the second diaphragm 40 are bonded by such as an adhesive or the like.

A space positioned between the first diaphragm 30 and the second diaphragm 40 functions as a first pump chamber 21. The first pump chamber 21 is formed by the first diaphragm 30, the second diaphragm 40, and the first spacer 60A, and is configured with a flat substantially cylindrical space. Here, the first spacer 60A corresponds to a circumferential wall member forming the first pump chamber 21 and connecting the first diaphragm 30 and the second diaphragm 40.

The second spacer 60B is positioned between the first diaphragm 30 and the third diaphragm 50, and is sandwiched by the first diaphragm 30 and the third diaphragm 50. The second spacer 60B is formed of a metal member made of such as stainless steel or the like, and has a substantially annular plate outer shape.

The second spacer 60B connects the peripheral region excluding the outermost end of the first diaphragm 30 and the peripheral region of the third diaphragm 50. Thus, the first diaphragm 30 and the third diaphragm 50 are placed with a predetermined distance determined by the second spacer 60B. The second spacer 60B and the first diaphragm 30 are bonded by such as an adhesive or the like, and the second spacer 60B and the third diaphragm 50 are bonded by such as an adhesive or the like.

A space positioned between the first diaphragm 30 and the third diaphragm 50 functions as a second pump chamber 22. The second pump chamber 22 is formed by the first diaphragm 30, the third diaphragm 50, and the second spacer 60B, and is configured with a flat substantially cylindrical space. Here, the second spacer 60B corresponds to the circumferential wall member forming the second pump chamber 22 and connecting the first diaphragm 30 and the third diaphragm 50.

The first valve supporting member 70A is attached to the central region of the first diaphragm 30 by such as an adhesive or the like, and more specifically, the first valve supporting member 70A is disposed on a side where the third diaphragm 50 is positioned when viewed from the first diaphragm 30. The first valve supporting member 70A is formed of a metal thin plate made of such as stainless steel or the like, and has a substantially circular outer shape in a plan view. The first valve supporting member 70A includes a first annular step portion 71*a* that recedes in a direction apart from the first diaphragm 30 on the peripheral region of a main surface positioned on the first diaphragm 30 side, and the first annular step portion 71*a* faces the first hole portions 31 provided to the first diaphragm 30.

The first check valve 80A is formed of a member made of resin such as polyimide resin or the like, and has a substantially annular plate outer shape. The first check valve 80A is loosely fitted to the first annular step portion 71*a* of the first valve supporting member 70A to be housed in the first annular step portion 71*a*. That is, the first check valve 80A is positioned between the first annular step portion 71*a* of the first valve supporting member 70A and a portion of the first diaphragm 30 facing the first annular step portion 71*a*.

Thus, the first check valve 80A is movably supported by the first valve supporting member 70A such that the first check valve 80A is able to open and close the first hole portions 31 provided to the first diaphragm 30. More specifically, the first check valve 80A closes the first hole portions 31 in a state that the first check valve 80A moves in proximity to and is in close contact with the first diaphragm 30, and opens the first hole portions 31 in a state that the first check valve 80A is moved away from the first diaphragm 30.

The second valve supporting member 70B is attached to the central region of the second diaphragm 40 by such as an adhesive or the like, and more specifically, the second valve supporting member 70B is disposed on a side where the first diaphragm 30 is positioned when viewed from the second diaphragm 40. The second valve supporting member 70B is formed of a metal thin plate made of such as stainless steel or the like, and has a substantially circular outer shape in a plan view. The second valve supporting member 70B includes a second annular step portion 71*b* that recedes in a direction apart from the second diaphragm 40 on the peripheral region of a main surface positioned on the second diaphragm 40 side, and the second annular step portion 71*b* faces the second hole portions 41 provided to the second diaphragm 40.

The second check valve 80B is formed of a member made of resin such as polyimide resin or the like, and has a substantially annular plate outer shape. The second check valve 80B is loosely fitted to the second annular step portion 71*b* of the second valve supporting member 70B to be housed in the second annular step portion 71*b*. That is, the second check valve 80B is positioned between the second annular step portion 71*b* of the second valve supporting member 70B and a portion of the second diaphragm 40 facing the second annular step portion 71*b*.

Thus, the second check valve 80B is movably supported by the second valve supporting member 70B such that the second check valve 80B is able to open and close the second hole portions 41 provided to the second diaphragm 40. More specifically, the second check valve 80B closes the second hole portions 41 in a state that the second check valve 80B moves in proximity to and is in close contact with the second diaphragm 40, and opens the second hole portions 41 in a state that the second check valve 80B is moved away from the second diaphragm 40.

The third valve supporting member 70C is attached to the central region of the third diaphragm 50 by such as an adhesive or the like, and more specifically, the third valve supporting member 70C is disposed on a side opposite to a side where the first diaphragm 30 is positioned when viewed from the third diaphragm 50. The third valve supporting member 70C is formed of a metal thin plate made of such as stainless steel or the like, and has a substantially circular outer shape in a plan view. The third valve supporting member 70C includes a third annular step portion 71*c* that recedes in a direction apart from the third diaphragm 50 on the peripheral region of a main surface positioned on the third diaphragm 50 side, and the third annular step portion 71*c* faces the third hole portions 51 provided to the third diaphragm 50.

The third check valve 80C is formed of a member made of resin such as polyimide resin or the like, and has a substantially annular plate outer shape. The third check valve 80C is loosely fitted to the third annular step portion 71*c* of the third valve supporting member 70C to be housed in the third annular step portion 71*c*. That is, the third check valve 80C is positioned between the third annular step portion 71*c* of the third valve supporting member 70C and a portion of the third diaphragm 50 facing the third annular step portion 71*c*.

Thus, the third check valve 80C is movably supported by the third valve supporting member 70C such that the third check valve 80C is able to open and close the third hole portions 51 provided to the third diaphragm 50. More specifically, the third check valve 80C closes the third hole portions 51 in a state that the third check valve 80C moves in proximity to and is in close contact with the third diaphragm 50, and opens the third hole portions 51 in a state that the third check valve 80C is moved away from the third diaphragm 50.

The piezoelectric element 90 is attached to the first valve supporting member 70A with such as an adhesive or the like, and consequently the piezoelectric element 90 is attached to the central region of the first diaphragm 30 with the first valve supporting member 70A interposed therebetween. Thus, the piezoelectric element 90 is attached to the main surface side positioned on a side facing the second pump chamber 22 of the first diaphragm 30. The piezoelectric element 90 is formed of a thin plate made of a piezoelectric material such as lead zirconate titanate (PZT) or the like, and has a substantially circular outer shape in a plan view.

The piezoelectric element 90 performs flexural vibration by application of an AC voltage, and the flexural vibration generated in the piezoelectric element 90 is propagated to the first diaphragm 30, the second diaphragm 40, and the third diaphragm 50, so that the first diaphragm 30, the second diaphragm 40, and the third diaphragm 50 also perform flexural vibration. That is, the piezoelectric element 90 corresponds to the driving member for causing flexural vibration in the first diaphragm 30, the second diaphragm 40, and the third diaphragm 50, and when an AC voltage with a predetermined frequency is applied to the piezoelectric element 90, the first diaphragm 30, the second diaphragm 40, and the third diaphragm 50 are respectively caused to vibrate at resonant frequency, thereby generating standing waves in the first diaphragm 30, the second diaphragm 40, and the third diaphragm 50, respectively.

Here, the piezoelectric element 90 does not necessarily have a substantially circular shape in a plan view, and may have a substantially regular polygonal shape in a plan view. When the piezoelectric element 90 has a substantially circular shape or a substantially regular polygonal shape in a plan view, it is preferable that the first diaphragm 30 and the piezoelectric element 90 be arranged such that a center of the first diaphragm 30 and a center of the piezoelectric element 90 coincide with each other. With the configuration above, the standing wave can more reliably and easily be generated in the first diaphragm 30.

With having the configuration above, in the piezoelectric blower 1A according to the present embodiment, the first pump chamber 21 and the second pump chamber 22 are positioned between the first nozzle portion 14 and the second nozzle portion 15. Of the housing space 13 of the case 10, a space, which is closer to the first nozzle portion 14 side than a position where the first pump chamber 21 is provided, and the first pump chamber 21 communicate through the second hole portions 41 in a state that the second hole portions 41 provided to the second diaphragm 40 is not closed by the second check valve 80B. Of the housing space 13 of the case 10, a space, which is closer to the second nozzle portion 15 side than a position where the second pump chamber 22 is provided, and the second pump chamber 22 communicate through the third hole portions 51 in a state that the third hole portions 51 provided to the third diaphragm 50 is not closed by the third check valve 80C. Further, the first pump chamber 21 and the second pump chamber 22 communicate with each other through the first hole portions 31 in a state that the first hole portions 31 provided to the first diaphragm 30 is not closed by the first check valve 80A.

In the piezoelectric blower 1A according to the present embodiment, the piezoelectric element 90 causes the first diaphragm 30, the second diaphragm 40, and the third diaphragm 50 to perform flexural vibration such that standing waves are generated in the first diaphragm 30, the second diaphragm 40, and the third diaphragm 50, respectively, around an axial line 100 orthogonal to a central region of the first diaphragm 30, a central region of the second diaphragm 40, and a central region of the third diaphragm 50. More specifically, the piezoelectric element 90 causes the first diaphragm 30, the second diaphragm 40, and the third diaphragm 50 to perform flexural vibration such that the antinode of vibration is formed in the central region of the first diaphragm 30, the central region of the second diaphragm 40, and the central region of the third diaphragm 50 respectively, and such that the antinode of vibration is also formed at a position excluding the central region of the first diaphragm 30, a position excluding the central region of the second diaphragm 40, and a position excluding the central region of the third diaphragm 50. In the piezoelectric blower 1A according to the present embodiment, the first diaphragm 30, the second diaphragm 40, and the third diaphragm 50 are driven such that the one antinode of vibration is respectively formed in a radial direction at a position excluding the central region of each diaphragm.

The piezoelectric element 90 directly drives the first diaphragm 30 to which the piezoelectric element 90 is attached. The piezoelectric element 90 indirectly drives the second diaphragm 40 and the third diaphragm 50 to which the piezoelectric element 90 is not attached through the first spacer 60A as the first circumferential wall member and the second spacer 60B as the second circumferential wall member. At this time, with an appropriate design of a shape of the first diaphragm 30 and a shape of the second diaphragm 40 (in particular, thickness of diaphragms), the first diaphragm 30 and the second diaphragm 40 are respectively displaced in opposite directions. Similarly, with an appropriate design of a shape of the first diaphragm 30 and a shape of the third diaphragm 50 (in particular, thickness of diaphragms), the first diaphragm 30 and the third diaphragm 50 are respectively displaced in opposite directions.

The first pump chamber 21 repeats expansion and contraction due to the vibration of the first diaphragm 30 and the second diaphragm 40 in opposite directions, and the second pump chamber 22 repeats expansion and contraction due to the vibration of the first diaphragm 30 and the third diaphragm 50 in opposite directions. As the result, resonance occurs inside the first pump chamber 21 and inside the second pump chamber 22 respectively, so that a large pressure change occurs in each of the first pump chamber 21 and the second pump chamber 22. Thus, positive pressure and negative pressure are generated in the first pump chamber 21 and the second pump chamber 22 alternately in terms of time, and a pump function of pressure feed of gas is realized by the pressure change.

Each of FIGS. 3A, 3B and 3C is a schematic diagram describing a configuration of the driving unit in the piezoelectric blower illustrated in FIG. 1, an approximate direction of a gas flow generated during operation, and a pressure change generated in a first pump chamber and a second pump chamber. Each of FIGS. 4A and 4B is a schematic diagram describing an operation status of the driving unit in the piezoelectric blower illustrated in FIG. 1 and a direction of a gas flow generated in each status over time. Next, the operation status of the piezoelectric blower 1A according to the present embodiment will be described in detail with reference to FIGS. 3A, 3B and 3C, and FIGS. 4A and 4B.

As described in FIGS. 3A, 3B and 3C, in the piezoelectric blower 1A according to the present embodiment, the first check valve 80A is provided to each of the first hole portions 31 provided to the first diaphragm 30, the second check valve 80B is provided to each of the second hole portions 41 provided to the second diaphragm 40, and the third check valve 80C is provided to each of the third hole portions 51 provided to the third diaphragm 50 as described above.

Here, the first check valve 80A provided to each of the first hole portions 31 enables a gas flow from the first pump chamber 21 toward the second pump chamber 22, but is configured so as to disable the gas flow in the opposite direction. The second check valve 80B provided to each of the second hole portions 41 enables a gas flow from a space in the first nozzle portion 14 side of the housing space 13 of the case 10 toward the first pump chamber 21, but is configured so as to disable the gas flow in the opposite direction. The third check valve 80C provided to each of the third hole portions 51 enables a gas flow from the second pump chamber 22 toward a space in the second nozzle portion 15 side of the housing space 13 of the case 10, but is configured so as to disable the gas flow in the opposite direction. Therefore, the direction of the gas flow generated during the operation of the piezoelectric blower 1A is determined by an action of the first check valve 80A, the second check valve 80B, and the third check valve 80C, and the approximate direction of the gas flow is illustrated with an arrow in FIG. 3A.

Specifically, as illustrated in FIG. 4A, when the central region of the first diaphragm 30 and the central region of the second diaphragm 40 are displaced in a direction to which they move close to each other and the central region of the first diaphragm 30 and the central region of the third diaphragm 50 are displaced in a direction to which they move apart from each other, negative pressure is generated in the vicinity of the first hole portions 31 of the first pump chamber 21 and positive pressure is generated in the vicinity of the first hole portions 31 of the second pump chamber 22, whereby the first check valve 80A closes the first hole portions 31. In the state above, since the negative pressure is generated in the vicinity of the second hole portions 41 of the first pump chamber 21, the second check valve 80B opens the second hole portions 41. In addition, in the state above, since the positive pressure is generated in the vicinity of the third hole portions 51 of the second pump chamber 22, the third check valve 80C opens the third hole portions 51. At this time, since the volume of the first pump chamber 21 is decreased as a whole and the volume of the second pump chamber 22 is increased as a whole, gas is suctioned into the first pump chamber 21 through the second hole portions 41 provided to the second diaphragm 40, and gas is discharged from the second pump chamber 22 through the third hole portions 51 provided to the third diaphragm 50.

Then, as illustrated in FIG. 4B, when the central region of the first diaphragm 30 and the central region of the second diaphragm 40 are displaced in a direction to which they move apart from each other, and the central region of the first diaphragm 30 and the central region of the third diaphragm 50 are displaced in a direction to which they move close to each other, positive pressure is generated in the vicinity of the first hole portions 31 of the first pump chamber 21 and negative pressure is generated in the vicinity of the first hole portions 31 of the second pump chamber 22, whereby the first check valve 80A opens the first hole portions 31. In the state above, since the positive pressure is generated in the vicinity of the second hole portions 41 of the first pump chamber 21, the second check valve 80B closes the second hole portions 41. In addition, in the state above, since the negative pressure is generated in the vicinity of the third hole portions 51 of the second pump chamber 22, the third check valve 80C closes the third hole portions 51. Thus, the gas is transferred from the first pump chamber 21 to the second pump chamber 22 through the first hole portions 31.

Since the first diaphragm 30, the second diaphragm 40, and the third diaphragm 50 are vibrated so that the state described in FIG. 4A and the state described in FIG. 4B are alternately repeated, the gas flow direction described in FIG. 3A is generated in the piezoelectric blower 1A. Therefore, the first nozzle portion 14 provided to the case 10 functions as a suction nozzle for suctioning gas from the outside, and the second nozzle portion 15 provided to the case 10 functions as a discharge nozzle for discharging the gas to the outside, whereby the gas is pressure-fed by the piezoelectric blower 1A.

FIG. 3B schematically illustrates the pressure distribution in each of the first pump chamber 21 and the second pump chamber 22 in the state described in FIG. 4A (hereinafter referred to as the first state), and FIG. 3C schematically illustrates the pressure distribution in each of the first pump chamber 21 and the second pump chamber 22 in the state described in FIG. 4B (hereinafter referred to as the second state).

As is evident from FIG. 3B and FIG. 3C, in the piezoelectric blower 1A according to the present embodiment, when the first diaphragm 30, the second diaphragm 40 and the third diaphragm 50 are driven with the condition described above that the resonance occurs in each of the first pump chamber 21 and the second pump chamber 22, an antinode and a node of the pressure change occur as follows. An antinode of the pressure change in the first pump chamber 21 is formed in the central region of the first pump chamber 21, a node of the pressure change in the first pump chamber 21 is formed in an outer side of the antinode, another antinode of the pressure change in the first pump chamber 21 is formed in an outer side of the node, and another node of the pressure change in the first pump chamber 21 is formed in an outermost end portion of the first pump chamber 21. An antinode of the pressure change in the second pump chamber 22 is formed in the central region of the second pump chamber 22, a node of the pressure change in the second pump chamber 22 is formed in an outer side of the antinode, another antinode of the pressure change in the second pump chamber 22 is formed in an outer side of the node, and another node of the pressure change in the second pump chamber 22 is formed in an outermost end portion of the second pump chamber 22.

Here, in the piezoelectric blower 1A according to the present embodiment, the first hole portions 31 provided to the first diaphragm 30, the second hole portions 41 provided to the second diaphragm 40, and the third hole portions 51 provided to the third diaphragm 50 satisfy the following conditions as described in FIG. 3A.

The first hole portions 31 are provided to the first diaphragm 30 in a region not overlapping the axial line 100 when viewed in the extending direction of the axial line 100 and not overlapping the node of vibration formed in the first diaphragm 30, and the first check valve 80A is provided to the first hole portions 31. More specifically, the first hole portions 31 are provided to a region overlapping the antinode of vibration formed at a position excluding the central region of the first diaphragm 30. The first hole portions 31 are arranged with an interval therebetween in a position on a circumference around the axial line 100 when viewed in the extending direction of the axial line 100.

The second hole portions 41 are provided to the second diaphragm 40 in a region not overlapping the axial line 100 when viewed in the extending direction of the axial line 100 and not overlapping the node of vibration formed in the second diaphragm 40 (in other words, each of the second hole portions 41 are not provided in a region overlapping the node of vibration formed in the first diaphragm 30 when viewed in the extending direction of the axial line 100), and the second check valve 80B is provided to the second hole portions 41. More specifically, the second hole portions 41 are provided to a region overlapping the antinode of vibration formed at a position excluding the central region of the second diaphragm 40 (in other words, each of the second hole portions 41 are provided to a region overlapping the antinode of vibration formed in the first diaphragm 30 when viewed in the extending direction of the axial line 100). The second hole portions 41 are arranged with an interval therebetween in a position on a circumference around the axial line 100 when viewed in the extending direction of the axial line 100.

The third hole portions 51 are provided to the third diaphragm 50 in a region not overlapping the axial line 100 when viewed in the extending direction of the axial line 100 and not overlapping the node of vibration formed in the third diaphragm 50 (in other words, each of the third hole portions 51 is not provided in a region overlapping the node of vibration formed in the first diaphragm 30 when viewed in the extending direction of the axial line 100), and the third check valve 80C is provided to the third hole portions 51. More specifically, the third hole portions 51 are provided in a region overlapping the antinode of vibration formed at a position excluding the central region of the third diaphragm 50 (in other words, each of the third hole portions 51 is provided in a region overlapping the antinode of vibration formed in the first diaphragm 30 when viewed in the extending direction of the axial line 100). The third hole portions 51 are arranged with an interval therebetween in a position on a circumference around the axial line 100 when viewed in the extending direction of the axial line 100.

Note that the first diaphragm 30, the second diaphragm 40, the third diaphragm 50, the first spacer 60A, and the second spacer 60B which form the first pump chamber 21 and the second pump chamber 22 are not provided with holes other than holes in the first hole portions 31, the second hole portions 41, and the third hole portions 51.

With the configuration above, the piezoelectric blower 1A according to the present embodiment can increase the flow rate in comparison with the related art. The reason will be described in detail below.

In the piezoelectric blower 1A according to the present embodiment, the first check valve 80A, the second check valve 80B, and the third check valve 80C for determining the direction of the gas flow in the piezoelectric blower 1A are respectively provided to the first hole portions 31 provided in the intermediate region excluding the central region and the peripheral region of the first diaphragm 30, to the second hole portions 41 provided in the intermediate region excluding the central region and the peripheral region of the second diaphragm 40, and to the third hole portions 51 provided in the intermediate region excluding the central region and the peripheral region of the third diaphragm 50. With the configuration above, in comparison with a configuration in which the hole portions with a check valve are provided in the central region of the diaphragm, the flow path resistance to the gas passing through the first hole portions 31, the second hole portions 41, and the third hole portions 51 is significantly reduced, so that the flow rate through these portions can be increased.

However, as described above, since the displacement amount in the intermediate region excluding the central region and the peripheral region of the diaphragm is smaller than that in the central region of the diaphragm, the action of opening and closing of the check valve is likely to be insufficient by adopting the above-described configuration alone.

In order to solve the problem, in the piezoelectric blower 1A according to the present embodiment, particularly, a pair of the second diaphragm 40 and the third diaphragm 50 are disposed so as to face the first diaphragm 30 to which the first hole portions 31 with the first check valve 80A are provided, so that the first diaphragm 30 is sandwiched by the first pump chamber 21 and the second pump chamber 22. With this, it is possible to reliably open and close the first check valve 80A using a differential pressure between the positive pressure and the negative pressure generated in the first pump chamber 21 and the second pump chamber 22.

That is, as described in FIG. 3B, in the first state, the negative pressure is generated in the vicinity of the first hole portions 31 of the first pump chamber 21, and the positive pressure is generated in the vicinity of the first hole portions 31 of the second pump chamber 22, so that the differential pressure ΔP makes it possible to more reliably achieve a state in which the first check valve 80A is closed. As described in FIG. 3C, in the second state, the positive pressure is generated in the vicinity of the first hole portions 31 of the first pump chamber 21, and the negative pressure is generated in the vicinity of the first hole portions 31 of the second pump chamber 22, so that the differential pressure ΔP makes it possible to more reliably achieve a state in which the first check valve 80A is opened.

Further, by providing the second check valve 80B to the second hole portions 41 provided to the second diaphragm 40 and providing the third check valve 80C to the third hole portions 51 provided to the third diaphragm 50, in the second state described above, the second hole portions 41 and the third hole portions 51 are closed by the second check valve 80B and the third check valve 80C, respectively. Thus, in the second state, the positive pressure in the vicinity of the first hole portions 31 of the first pump chamber 21 is maintained to be higher, and the negative pressure in the vicinity of the first hole portions 31 of the second pump chamber 22 is maintained to be lower. As the result, the above-described differential pressure ΔP becomes particularly large, and accordingly, the state in which the first check valve 80A is opened is made to be achieved more reliably.

Here, in the piezoelectric blower 1A according to the present embodiment, as described above, since the first hole portions 31 are provided so as to overlap the antinode of vibration formed at a position of the first diaphragm 30 excluding the central region of the first diaphragm 30, the differential pressure ΔP between the first pump chamber 21 and the second pump chamber 22 can be secured to be larger, and the action of opening and closing of the first check valve 80A can also be made to be more reliable in this respect.

Further, in the piezoelectric blower 1A according to the present embodiment, as described above, since the second hole portions 41 provided to the second diaphragm 40 are arranged so as to overlap the antinode of vibration formed in the second diaphragm 40, and the third hole portions 51 provided to the third diaphragm 50 are arranged so as to overlap the antinode of vibration formed in the third diaphragm 50, it is possible to reliably open and close the second check valve 80B provided to the second hole portions 41 and also open and close the third check valve 80C provided to the third hole portions 51.

Therefore, in the piezoelectric blower 1A according to the present embodiment, the flow path resistance in the driving unit 20A is lowered and the action of opening and closing of the first check valve 80A, the second check valve 80B, and the third check valve 80C may be ensured, so that the flow rate may be increased in comparison with the related art. Further, since the second check valve 80B is provided to each of the second hole portions 41 provided to the second diaphragm 40, and the third check valve 80C is provided to each of the third hole portions 51 provided to the third diaphragm 50, the pressure amplitude due to the pressure change in the first pump chamber 21 and the pressure amplitude due to the pressure change in the second pump chamber 22 can be increased in comparison with the related art, and a piezoelectric pump with high suction pressure and high discharge pressure can be realized.

In the piezoelectric blower 1A according to the present embodiment, as described above, since the second hole portions 41 provided to the second diaphragm 40 and the third hole portions 51 provided to the third diaphragm 50 are arranged in an annular shape with an interval therebetween, the axial symmetricity of the gas flow in the piezoelectric blower 1A is improved and turbulence is not easily generated in the gas flow. Thus, an efficient air flow can be achieved, and as the result, the flow rate can be increased.

FIG. 5 is a plan view of the first diaphragm illustrated in FIG. 1. Hereinafter, with reference to FIG. 5, a more preferable configuration for increasing the flow rate in the piezoelectric blower 1A according to the present embodiment will be described.

As illustrated in FIG. 5, in the piezoelectric blower 1A according to the present embodiment, as described above, the first hole portions 31 are provided in an annular shape with an interval therebetween in the intermediate region excluding the central region and the peripheral region of the first diaphragm 30. With the configuration above, since the flow path resistance in the first hole portions 31 provided to the first diaphragm 30 is reduced, it can be possible to increase the flow rate.

Here, it is preferable that the first hole portions 31 be formed of substantially cylindrical holes with the same opening diameter and be arranged with the same intervals. With the configuration above, the axial symmetricity of the gas flow in the piezoelectric blower 1A is improved, so that the turbulence is not easily generated in the gas flow, and the efficient gas flow can be realized, and as the result, the flow rate can be increased.

In addition, it is preferable that a distance D1 between the adjacent first hole portions among the first hole portions 31 is smaller than a distance D2 between the axial line 100 and each of the first hole portions 31. The reason is as follows. Part of the gas positioned in the vicinity of the first hole portions 31 of the first pump chamber 21 moves toward the central region of the first pump chamber 21 due to the pressure change in the first pump chamber 21, and is reflected at the center region to return to the original position. However, by adopting the configuration described above, large part of the gas positioned in the vicinity of the first hole portions 31 flows into the first hole portions 31 preferentially, whereby proportion of the gas moving toward the central region of the first pump chamber 21 can be reduced, and as the result, an overall flow rate of the piezoelectric blower 1A can be increased.

In the piezoelectric blower 1A according to the present embodiment, each of the first hole portions 31 arranged in an annular shape with an interval therebetween is positioned outside the piezoelectric element 90 when viewed in the extending direction of the axial line 100. With the configuration above, the first pump chamber 21 and the second pump chamber 22 may easily communicate with each other without providing a through-hole or the like in the piezoelectric element 90. When the through-hole is provided in the piezoelectric element 90, it is not necessarily advantageous in terms of manufacturing cost, reliability, and the like. By contrast, with the configuration described above, there is no need to provide the through-hole in the piezoelectric element 90, and it is possible to provide a piezoelectric blower with lower cost and high reliability.

Although the dimensions of the piezoelectric blower 1A according to the present embodiment described above and such as the number of various holes provided to the first diaphragm 30, the second diaphragm 40, and the third diaphragm 50 are not particularly limited, examples thereof are as follows.

The diameter of the first diaphragm 30 is about 25 mm, for example, and in that, the diameter of the portion forming the first pump chamber 21 and the second pump chamber 22 is about 19 mm, for example. The diameter of the second diaphragm 40 is about 23 mm, for example, and in that, the diameter of the portion forming the first pump chamber 21 is about 19 mm, for example. The diameter of the third diaphragm 50 is about 23 mm, for example, and in that, the diameter of the portion forming the second pump chamber 22 is about 19 mm, for example. The thicknesses of the first diaphragm 30, the second diaphragm 40, and the third diaphragm 50 are the same, and is about 0.2 mm, for example. The outer diameter and inner diameter of each of the first spacer 60A and the second spacer 60B are about 23 mm and about 19 mm, respectively, and the thickness thereof is about 0.3 mm, for example.

The first hole portions 31 provided to the first diaphragm 30 are arranged in an annular shape with an interval therebetween, spaced apart from the central region of the first diaphragm 30 by about 6 mm, for example, and each opening diameter thereof is about 0.4 mm, for example, and the number thereof is about 50. The second hole portions 41 provided to the second diaphragm 40 are arranged in an annular shape with an interval therebetween, spaced apart from the central region of the second diaphragm 40 by about 6 mm, for example, and each opening diameter thereof is about 0.4 mm, for example, and the number thereof is about 50. The third hole portions 51 provided to the third diaphragm 50 are arranged in an annular shape with an interval therebetween, spaced apart from the central region of the third diaphragm 50 by about 6 mm, for example, and each opening diameter thereof is about 0.4 mm, for example, and the number thereof is about 50.

(Modification 1)

FIG. 6 is a schematic diagram describing a configuration of a driving unit in a piezoelectric blower and an approximate direction of a gas flow generated during operation according to Modification 1 based on Embodiment 1. With reference to FIG. 6, a piezoelectric blower 1A' according to Modification 1 will be described.

As illustrated in FIG. 6, the piezoelectric blower 1A' according to Modification 1 includes a driving unit 20A' having a configuration different from that of the piezoelectric blower 1A according to Embodiment 1. As with the driving unit 20A of the piezoelectric blower 1A according to Embodiment 1, the driving unit 20A' includes the first diaphragm 30, the second diaphragm 40, the third diaphragm 50, the first spacer 60A, the second spacer 60B, the first check valve 80A, the second check valve 80B, the third check valve 80C, the piezoelectric element 90, and the like. However, the position and the configuration of the piezoelectric element 90 in the driving unit 20A' are different from those in the driving unit 20A.

Specifically, in the piezoelectric blower 1A' according to the Modification 1, the piezoelectric element 90 is attached to the main surface positioned on a side facing the first pump chamber 21 of the first diaphragm 30 with an adhesive, for example. That is, unlike the piezoelectric blower 1A according to Embodiment 1, the piezoelectric element 90 is directly attached to the first diaphragm 30 without the first valve supporting member 70A interposed therebetween.

With the configuration above, the same effects as those described in Embodiment 1 can also be obtained, and it is possible to provide a piezoelectric blower with an increased flow rate in comparison with the related art.

(Modification 2)

FIG. 7 is an exploded perspective view of a piezoelectric blower according to Modification 2 based on Embodiment 1. Hereinafter, with reference to FIG. 7, a piezoelectric blower 1A" according to the Modification 2 will be described.

As illustrated in FIG. 7, the piezoelectric blower 1A" according to Modification 2 includes a driving unit 20A" having a configuration different from that of the piezoelectric blower 1A according to Embodiment 1. As with the driving unit 20A of the piezoelectric blower 1A according to Embodiment 1, the driving unit 20A" includes the first diaphragm 30, the second diaphragm 40, the third diaphragm 50, the first spacer 60A, the second spacer 60B, the first check valve 80A, the second check valve 80B, the third check valve 80C, the piezoelectric element 90, and the like. However, in those, the number of holes provided to the second diaphragm 40 and the third diaphragm 50 are different from those in the driving unit 20A.

Specifically, in the piezoelectric blower 1A" according to Modification 2, the number of the second hole portions 41 provided to the second diaphragm 40 and the number of the third hole portions 51 provided to the third diaphragm 50 are significantly reduced respectively in comparison with the piezoelectric blower 1A according to Embodiment 1, and each of the total number is 10. Thus, the total number of the second hole portions 41 and the total number of the third hole portions 51 are respectively smaller than the total number of the first hole portions 31.

With the configuration above, large dispersion of the pressure change is not easily generated between the region in the vicinity of the second hole portions 41 provided to the second diaphragm 40 of the first pump chamber 21 and the region in the vicinity of the third hole portions 51 provided to the third diaphragm 50 of the second pump chamber 22. Thus, the second check valve 80B provided to the second hole portions 41 and the third check valve 80C provided to the third hole portions 51 may also reliably be opened and closed. The flow rate is increased also in this respect.

With the configuration above, it is also possible to obtain effects similar to those described in Embodiment 1, and it is possible to provide a piezoelectric blower with an increased flow rate in comparison with the related art. Thus, the number of holes provided to the second diaphragm 40 and the third diaphragm 50 is not limited to any specific number, and may be at least one or more.

In the present modification, in comparison with the piezoelectric blower 1A according to Embodiment 1, exemplified is a case where the number of the second hole portions 41 provided to the second diaphragm 40 and the number of the third hole portions 51 provided to the third diaphragm 50 are both reduced, however, either one alone of the number of the second hole portions 41 provided to the second diaphragm 40 and the number of the third hole portions 51 provided to the third diaphragm 50 may be reduced.

Embodiment 2

Each of FIGS. 8A, 8B and 8C is a schematic diagram describing a configuration of a driving unit in a piezoelectric blower, an approximate direction of a gas flow generated during operation, and a pressure change generated in a first pump chamber and a second pump chamber according to Embodiment 2 of the present disclosure. Hereinafter, with reference to FIGS. 8A, 8B and 8C, a piezoelectric blower 1B according to the present embodiment will be described.

As illustrated in FIG. 8A, the piezoelectric blower 1B according to the present embodiment includes a driving unit 20B having a configuration different from that of the piezoelectric blower 1A according to Embodiment 1. As with the driving unit 20A of the piezoelectric blower 1A according to Embodiment 1, the driving unit 20B includes the first diaphragm 30, the second diaphragm 40, the third diaphragm 50, the first spacer 60A, the second spacer 60B, the first check valve 80A, the second check valve 80B, the third check valve 80C, the piezoelectric element 90, and the like. However, the configuration of holes provided to the second diaphragm 40 and the third diaphragm 50 is different from that in the driving unit 20A.

Specifically, the second diaphragm 40 is provided with the second hole portions 41 in a region outside relative to the central region of the second diaphragm 40 and inside relative to the innermost node of vibration among nodes of vibration formed in the second diaphragm 40. The second hole portions 41 are arranged with an interval therebetween in a position on a circumference around the axial line 100 when viewed in an extending direction of the axial line 100.

In addition, the third diaphragm 50 is provided with the third hole portions 51 in a region outside relative to the central region of the third diaphragm 50 and inside relative to the innermost node of vibration among nodes of vibration formed in the third diaphragm 50. The third hole portions 51 are arranged with an interval therebetween in a position on a circumference around the axial line 100 when viewed in the extending direction of the axial line 100.

When the configuration above is adopted, the pressure changes in the first pump chamber 21 and the second pump chamber 22 can also be obtained in the first state and the second state respectively, as illustrated in FIG. 8B and FIG. 8C, and as the result, the gas flow as illustrated in FIG. 8A is generated in the piezoelectric blower 1B.

Here, both in the region of the second diaphragm 40 provided with the second hole portions 41 and in the region of the third diaphragm 50 provided with the third hole portions 51, a displacement generated during operation is smaller than an antinode of vibration formed in the second diaphragm 40 and an antinode of vibration formed in the third diaphragm 50. However, with the configuration above, the effects similar to those described in Embodiment 1 can also be obtained and it is possible to provide a piezoelectric blower with an increased flow rate in comparison with the related art.

Embodiment 3

Each of FIGS. 9A, 9B and 9C is a schematic diagram describing a configuration of a driving unit in a piezoelectric blower, an approximate direction of a gas flow generated during operation, and a pressure change generated in a first pump chamber and a second pump chamber according to Embodiment 3. Hereinafter, with reference to FIGS. 9A, 9B and 9C, a piezoelectric blower 1C according to the present embodiment will be described.

As illustrated in FIG. 9A, the piezoelectric blower 1C according to the present embodiment includes a driving unit 20C having a configuration different from that of the piezoelectric blower 1A according to Embodiment 1. As with the driving unit 20A of the piezoelectric blower 1A according to Embodiment 1, the driving unit 20C includes the first diaphragm 30, the second diaphragm 40, the third diaphragm 50, the first spacer 60A, the second spacer 60B, the first check valve 80A, the second check valve 80B, the third check valve 80C, the piezoelectric element 90, and the like. However, the configuration of holes provided to the second diaphragm 40 and the third diaphragm 50 is different from that in the driving unit 20A.

Specifically, the second diaphragm 40 is provided with the one second hole portion 41 in a region overlapping the axial line 100 when viewed in the extending direction of the axial line 100, and the third diaphragm 50 is provided with the one third hole portion 51 in a region overlapping the axial line 100 when viewed in an extending direction of the axial line 100.

When the configuration above is adopted, the pressure changes in the first pump chamber 21 and the second pump chamber 22 can also be obtained in the first state and the second state respectively, as illustrated in FIG. 9B and FIG. 9C, and as the result, the gas flow as illustrated in FIG. 9A is generated in the piezoelectric blower 1C.

Here, both in the region of the second diaphragm 40 provided with the one second hole portion 41 and in the region of the third diaphragm 50 provided with the one third hole portion 51, the larger displacement is generated during operation, so that the effects similar to those described in Embodiment 1 can also be obtained with the configuration above, and it is possible to provide a piezoelectric blower with an increased flow rate in comparison with the related art.

Since the region of the second diaphragm 40 provided with the one second hole portion 41 and the region of the third diaphragm 50 provided with the one third hole portion 51 are the central regions of the second diaphragm 40 and the third diaphragm 50 respectively, the flow path resistance is basically larger than that in the case where the second hole portions 41 and the third hole portions 51 are provided in a region other than the central region. On the other hand, since both these regions are the antinodes of vibration, when the configuration above is adopted, it is possible to obtain an effect that not only the first check valve 80A provided to the first hole portions 31 provided to the first diaphragm 30 but also the second check valve 80B provided to the one second hole portion 41 and the third check valve 80C provided to the one third hole portion 51 can reliably be opened and closed.

Thus, with the configuration above, it is also possible to obtain effects similar to those described in Embodiment 1, and it is also possible to provide a piezoelectric blower with the increased flow rate in comparison with the related art.

Embodiment 4

Each of FIGS. 10A, 10B and 10C is a schematic diagram describing a configuration of a driving unit in a piezoelectric blower, an approximate direction of a gas flow generated during operation, and a pressure change generated in a first pump chamber and a second pump chamber according to Embodiment 4. Hereinafter, with reference to FIGS. 10A, 10B and 10C, a piezoelectric blower 1D according to the present embodiment will be described.

As illustrated in FIG. 10A, the piezoelectric blower 1D according to the present embodiment includes a driving unit 20D having a configuration different from that of the piezoelectric blower 1C according to Embodiment 3. As with the driving unit 20C of the piezoelectric blower 1C according to Embodiment 3, the driving unit 20D includes the first diaphragm 30, the second diaphragm 40, the third diaphragm 50, the first spacer 60A, the second spacer 60B, the first check valve 80A, the third check valve 80C, the piezoelectric element 90, and the like. However, the configuration of the driving unit 20D is different from that of the driving unit 20C only in that the driving unit 20D is not provided with the second check valve 80B.

When the configuration above is adopted, the pressure changes in the first pump chamber 21 and the second pump chamber 22 can be obtained in the first state and the second state respectively, as illustrated in FIG. 10B and FIG. 10C, and as the result, the gas flow as illustrated in FIG. 10A is generated in the piezoelectric blower 1D.

With the configuration above, by providing the third check valve 80C to the third hole portion 51 provided to the third diaphragm 50, in the second state described above, the third hole portion 51 are also closed by the third check valve 80C. Thus, in the second state, the negative pressure in the vicinity of the first hole portions 31 of the second pump chamber 22 is maintained to be lower, and as the result, the differential pressure ΔP between the first pump chamber 21 and the second pump chamber 22 becomes particularly large, and accordingly, the state in which the first check valve 80A is opened may be made to be achieved reliably.

Thus, with the configuration above, it is also possible to obtain effects similar to those described in Embodiment 1, and it is possible to provide a piezoelectric blower with an increased flow rate in comparison with the related art.

Embodiment 5

Each of FIGS. 11A, 11B and 11C is a schematic diagram describing a configuration of a driving unit in a piezoelectric blower, an approximate direction of a gas flow generated during operation, and a pressure change generated in a first pump chamber and a second pump chamber according to Embodiment 5 of the present disclosure. Hereinafter, with reference to FIGS. 11A, 11B and 11C, a piezoelectric blower 1E according to the present embodiment will be described.

As illustrated in FIG. 11A, the piezoelectric blower 1E according to the present embodiment includes a driving unit 20E having a configuration different from that of the piezoelectric blower 1C according to Embodiment 3. As with the driving unit 20C of the piezoelectric blower 1C according to Embodiment 3, the driving unit 20E includes the first diaphragm 30, the second diaphragm 40, the third diaphragm 50, the first spacer 60A, the second spacer 60B, the first check valve 80A, the second check valve 80B, the piezoelectric element 90, and the like. However, the configuration of the driving unit 20E is different from that of the driving unit 20C only in that the driving unit 20E is not provided with the third check valve 80C.

When the configuration above is adopted, the pressure changes in the first pump chamber 21 and the second pump chamber 22 can be obtained in the first state and the second state respectively, as illustrated in FIG. 11B and FIG. 11C, and as the result, the gas flow as illustrated in FIG. 11A is generated in the piezoelectric blower 1E.

With the configuration above, by providing the second check valve 80B to the second hole portion 41 provided to the second diaphragm 40, in the second state described above, the second hole portion 41 are also closed by the second check valve 80B. Thus, in the second state, the positive pressure in the vicinity of the first hole portions 31 of the first pump chamber 21 is maintained to be higher, and as the result, the differential pressure ΔP between the first pump chamber 21 and the second pump chamber 22 becomes particularly large, and accordingly, the state in which the first check valve 80A is opened may be made to be achieved reliably.

Thus, with the configuration above, it is also possible to obtain effects similar to those described in Embodiment 1, and it is also possible to provide a piezoelectric blower with an increased flow rate in comparison with the related art.

Embodiment 6

Each of FIGS. 12A, 12B and 12C is a schematic diagram describing a configuration of a driving unit in a piezoelectric blower, an approximate direction of a gas flow generated during operation, and a pressure change generated in a first pump chamber and a second pump chamber according to Embodiment 6 of the present disclosure. Hereinafter, with reference to FIGS. 12A, 12B and 12C, a piezoelectric blower 1F according to the present embodiment will be described.

As illustrated in FIG. 12A, the piezoelectric blower 1F according to the present embodiment includes a driving unit 20F having a configuration different from that of the piezoelectric blower 1B according to Embodiment 2. As with the driving unit 20F of the piezoelectric blower 1B according to Embodiment 2, the driving unit 20B includes the first diaphragm 30, the second diaphragm 40, the third diaphragm 50, the first spacer 60A, the second spacer 60B, the first check valve 80A, the second check valve 80B, the third check valve 80C, the piezoelectric element 90, and the like. However, the configuration of holes provided to the first diaphragm 30 is different from that in the driving unit 20B.

Specifically, the first hole portions 31 are provided to the first diaphragm 30 in a region not overlapping the axial line 100 when viewed in an extending direction of the axial line 100, outside relative to the antinode of vibration formed at a position excluding a central region of the first diaphragm 30, and inside relative to the peripheral region of the first diaphragm 30. The first hole portions 31 are arranged with an interval therebetween in a position on a circumference around the axial line 100 when viewed in the extending direction of the axial line 100.

When the configuration above is adopted, the pressure changes in the first pump chamber 21 and the second pump chamber 22 can also be obtained in the first state and the second state respectively, as illustrated in FIG. 12B and FIG. 12C, and as the result, the gas flow as illustrated in FIG. 12A is generated in the piezoelectric blower 1F.

Here, in the region of the first diaphragm 30 provided with the first hole portions 31, a displacement generated during operation is smaller than an antinode of vibration formed in the first diaphragm 30. However, with the configuration above, the effects similar to those described in Embodiment 1 can be obtained and it is possible to provide a piezoelectric blower with an increased flow rate in comparison with the related art.

When the first hole portions 31 are arranged in a region not overlapping the antinode of vibration formed in the first diaphragm 30, it is preferable that the first hole portions 31 be arranged in a region outside relative to the node of vibration formed in the position furthest from the central region of the first diaphragm 30 among the nodes of vibration formed in the region excluding the peripheral region of the first diaphragm 30, as in the present embodiment. This is because, at the time of driving, a volume change in the portion of the first pump chamber 21 and the second pump chamber 22 corresponding to the region described above becomes larger as a whole than the volume change in the portion of the first pump chamber 21 and the second pump chamber 22 corresponding to the region inside the nodes. Thus, with the configuration above, it is possible to obtain larger differential pressure.

(Other)

In Embodiments 1 to 6 and modifications thereof of the present disclosure, there has been exemplified and described the case where the first hole portions provided to the first plate member are arranged in an annular shape with an interval therebetween, however, the layout of the first hole portions is not limited to this arrangement and may be changed as appropriate.

In Embodiments 1 to 6 and modifications thereof of the present disclosure, there has been exemplified and described the case where both of the second hole portions provided to the second plate member and the third hole portions provided to the third plate member are arranged in an annular shape with an interval therebetween, however, the layout of the second hole portions and the third hole portions are not limited to this arrangement and may be changed as appropriate.

In Embodiments 1 to 6 and modifications thereof of the present disclosure, there has been exemplified and described the case where the piezoelectric element serving as the driving member is attached to one main surface side of the first plate member, however, a pair of piezoelectric elements may be provided and attached to both of the main surface sides of the first plate member. In this case, since the displacement of the first plate member can be increased, a further increase in the flow rate can be achieved.

In Embodiments 1 to 6 and modifications thereof of the present disclosure, there has been exemplified and described the case where the piezoelectric element serving as the driving member is attached to the first plate member, however, the piezoelectric element may be attached to the second plate member or to the third plate member or to both of the second and third plate member. In this case, it is possible to obtain an effect of facilitating wiring to the piezoelectric element.

In Embodiments 1 to 6 and modifications thereof of the present disclosure, there has been exemplified and described the case where the piezoelectric element causes the first, second, and third plate members to perform flexural vibration in which the antinode of vibration is formed in the central region of each of the first, second, and third plate members, and in addition to that, the one antinode of vibration in the radial direction is formed at a position excluding the central region of each of the first, second, and third plate members. However, the piezoelectric element may cause the first, second, and third plate member to perform flexural vibration so that the antinode of vibration is formed only in each of the central regions of the first, second, and third plate members. Further, the piezoelectric element may cause the first, second, and third plate member to perform flexural vibration in which the antinode of vibration is formed in the central region of each of the first, second, and third plate members, and in addition to that, two or more of the antinode of vibration in the radial direction is formed at a position excluding the central region of each of the first, second, and third plate members.

In Embodiments 1 to 6 and modifications thereof of the present disclosure, there has been exemplified and described the case where not only the first plate member but also the second plate member and the third plate member are caused to perform flexural vibration, however, the second plate member and the third plate member are not necessarily caused to perform the flexural vibration, and the first plate member alone may be caused to perform the flexural vibration.

Further, the characteristic configurations in Embodiments 1 to 6 and modifications thereof of the present disclosure can be appropriately combined without departing from the spirit and scope of the present disclosure.

Additionally, in Embodiments 1 to 6 and modifications thereof of the present disclosure, there has been exemplified and described the case where the present disclosure is applied to an piezoelectric blower which sanctions and discharges gas, however, the present disclosure may be applied to a pump which sanctions and discharges liquid and to a pump using other than a piezoelectric element as a driving member (obviously limited to a positive displacement pump using flexural vibration of a diaphragm).

In Embodiments 1 to 6 and modifications thereof of the present disclosure, the pump to which the present disclosure is applied alone is described in detail among pumps and fluid control devices to which the present disclosure is applied, however, the fluid control device to which the present disclosure is applied includes the pump to which the present disclosure is applied. That is, the fluid control device to which the present disclosure is applied is a fluid system including the pump to which the present disclosure is applied as a part (for example, the piezoelectric blower according to Embodiments 1 to 6 and modifications thereof of the present disclosure). The pump and other fluid control parts cooperatively control fluid behavior depending on application.

The embodiments and the modifications of the present disclosure are illustrative in all respects and are not intended to limit the scope of the present disclosure. The technical scope of the present disclosure is defined by the scope of the appended claims, and all changes that fall within the same essential spirit as the scope of the claims are intended to be included therein as well.

1A to 1F, 1A', and 1A" PIEZOELECTRIC BLOWER
10 CASE
11 FIRST CASE MEMBER
12 SECOND CASE MEMBER
13 HOUSING SPACE
14 FIRST NOZZLE PORTION
15 SECOND NOZZLE PORTION
20A to 20E, 20A', and 20A" DRIVING UNIT
21 FIRST PUMP CHAMBER
22 SECOND PUMP CHAMBER
30 FIRST DIAPHRAGM
31 FIRST HOLE PORTION
40 SECOND DIAPHRAGM
41 SECOND HOLE PORTION
50 THIRD DIAPHRAGM
51 THIRD HOLE PORTION
60A FIRST SPACER
60B SECOND SPACER
70A FIRST VALVE SUPPORTING MEMBER

70B SECOND VALVE SUPPORTING MEMBER
70C THIRD VALVE SUPPORTING MEMBER
71*a* FIRST ANNULAR STEP PORTION
71*b* SECOND ANNULAR STEP PORTION
71*c* THIRD ANNULAR STEP PORTION
80A FIRST CHECK VALVE
80B SECOND CHECK VALVE
80C THIRD CHECK VALVE
90 PIEZOELECTRIC ELEMENT
100 AXIAL LINE

The invention claimed is:

1. A pump comprising:

a first plate member;

a second plate member facing the first plate member;

a third plate member facing the first plate member and positioned on a side opposite from a side where the second plate member is positioned when viewed from the first plate member;

a first circumferential wall member connecting a peripheral region of the first plate member and a peripheral region of the second plate member;

a second circumferential wall member connecting the peripheral region of the first plate member and a peripheral region of the third plate member;

a first pump chamber positioned between the first plate member and the second plate member and is defined by the first plate member, the second plate member, and the first circumferential wall member;

a second pump chamber positioned between the first plate member and the third plate member, and is defined by the first plate member, the third plate member and the second circumferential wall member;

a first valve supporting member attached to the first plate member; and a driving member causing a pressure change in both of the first pump chamber and the second pump chamber by causing the first plate member to perform flexural vibration, wherein the first plate member is provided with two or more first hole portions each of which is provided with a first check valve, each of the two or more first hole portions is arranged in a region not overlapping an axial line orthogonal to a central region of the first plate member when viewed in an extending direction of the axial line, one or more second hole portions are provided to the second plate member, one or more third hole portions are provided to the third plate member, a second or third check valve is provided to either of the one or more second hole portions, or the one or more third hole portions, and the first valve supporting member is attached to the central region of the first plate member, and the first valve supporting member includes a first annular step portion at an outer circumferential region thereof and that is spaced from the first plate member, wherein the two or more first hole portions are aligned with the first annular step portion in the extending direction of the axial line, and wherein each first check valve of the two or more first hole portions is interposed between a respective one of the two or more first hole portions and the first annular step portion in the extending direction of the axial line.

2. The pump according to claim 1, wherein the driving member causes the first plate member to perform flexural vibration such that a standing wave is generated in the first plate member around the axial line and an antinode of vibration is provided in the central region of the first plate member, and each of the two or more first hole portions is arranged in a region not overlapping a node of vibration provided in the first plate member.

3. The pump according to claim 2, wherein the two or more first hole portions are arranged with an interval therebetween in a position on a circumference around the axial line when viewed in the extending direction of the axial line.

4. The pump according to claim 3, wherein a distance between adjacent first hole portions among the two or more first hole portions is smaller than a distance between the axial line and each of the two or more first hole portions.

5. The pump according to claim 2, wherein the first plate member is caused to perform flexural vibration by the driving member such that an antinode of vibration is further provided at a position excluding the central region of the first plate member.

6. The pump according to claim 5, wherein at least one of the two or more first hole portions is arranged in a region overlapping the antinode of vibration provided at a position excluding the central region of the first plate member.

7. The pump according to claim 6, wherein each of the two or more first hole portions is arranged in the region overlapping the antinode of vibration provided at the position excluding the central region of the first plate member.

8. The pump according to claim 5, wherein each of the two or more first hole portions is arranged in a region outside relative to a node of vibration provided at a position farthest from the central region of the first plate member among nodes of vibration provided in a region excluding the peripheral region of the first plate member.

9. The pump according to claim 5, wherein the second check valve is provided to the one or more second hole portions, and the one or more second hole portions are arranged in a region not overlapping the node of vibration provided in the first plate member when viewed in the extending direction of the axial line.

10. The pump according to claim 9, wherein the one or more second hole portions are arranged in a region overlapping the antinode of vibration provided at a position excluding the central region of the first plate member when viewed in the extending direction of the axial line.

11. The pump according to claim 5, wherein the third check valve is provided to the one or more third hole portions, and the one or more third hole portions are arranged in a region not overlapping the node of vibration provided in the first plate member when viewed in the extending direction of the axial line.

12. The pump according to claim 11, wherein the one or more third hole portions are arranged in a region overlapping the antinode of vibration provided at a position excluding the central region of the first plate member when viewed in the extending direction of the axial line.

13. The pump according to claim 1, wherein the driving member causes the first plate member to perform flexural vibration such that a standing wave is generated in the first plate member around the axial line and an antinode of vibration is provided in the central region of the first plate member, each of the two or more first hole portions is arranged in a region not overlapping a node of vibration provided in the first plate member, two or more second hole portions are provided, and the second check valve is provided to each of the two or more second hole portions, the two or more first hole portions are arranged with an interval therebetween in a position on a circumference around the axial line when viewed in the extending direction of the axial line, and the two or more second hole portions are arranged with an interval therebetween in a position on a circumference around the axial line when viewed in the extending direction of the axial line.

14. The pump according to claim 13, wherein the first plate member is caused to perform flexural vibration by the driving member such that an antinode of vibration is further provided at a position excluding the central region of the first plate member, and the two or more second hole portions are arranged in a region not overlapping the node of vibration provided in the first plate member when viewed in the extending direction of the axial line.

15. The pump according to claim 14, wherein each of the two or more first hole portions is arranged in a region overlapping the antinode of vibration provided at the position excluding the central region of the first plate member, and each of the two or more second hole portions is arranged in a region overlapping the antinode of vibration provided in the first plate member when viewed in the extending direction of the axial line.

16. The pump according to claim 13, wherein a total number of the two or more second hole portions is smaller than a total number of the two or more first hole portions.

17. The pump according to claim 13, wherein two or more third hole portions are provided, and the check valve is provided to each of the two or more third hole portions, and the two or more third hole portions are arranged with an interval therebetween in a position on a circumference around the axial line when viewed in the extending direction of the axial line.

18. The pump according to claim 17, wherein the first plate member is caused to perform flexural vibration by the driving member such that the antinode of vibration is further provided at a position excluding the central region of the first plate member, the two or more second hole portions are arranged in a region not overlapping the node of vibration provided in the first plate member when viewed in the extending direction of the axial line, and the two or more third hole portions are arranged in a region not overlapping the node of vibration provided in the first plate member when viewed in the extending direction of the axial line.

19. The pump according to claim 18, wherein each of the two or more first hole portions is arranged in a region overlapping the antinode of vibration provided at the position excluding the central region of the first plate member, each of the two or more second hole portions is arranged in a region overlapping the antinode of vibration provided in the first plate member when viewed in the extending direction of the axial line, and each of the two or more third hole portions is arranged in a region overlapping the antinode of vibration provided in the first plate member when viewed in the extending direction of the axial line.

20. The pump according to claim 17, wherein a total number of the two or more second hole portions is smaller than a total number of the two or more first hole portions, and a total number of the two or more third hole portions is smaller than the total number of the two or more first hole portions.

21. The pump according to claim 13, wherein the driving member causes the second plate member to perform flexural vibration such that a standing wave is generated in the second plate member around the axial line and an antinode of vibration is provided in a central region of the second plate member, and causes the third plate member to perform flexural vibration such that a standing wave is generated in the third plate member around the axial line and an antinode of vibration is provided in a central region of the third plate member.

22. The pump according to claim 1, wherein no holes other than the two or more first hole portions, the one or more second hole portions, and the one or more third hole portions are provided in any of the first plate member, the second plate member, the third plate member, the first circumferential wall member, and the second circumferential wall member.

23. The pump according to claim 1, wherein the driving member includes a piezoelectric element having a substantially flat plate shape, and the piezoelectric element is attached to the first valve supporting member such that the first valve supporting member is interposed between the piezoelectric element and the first plate member in the extending direction of the axial line.

24. The pump according to claim 23, wherein each of the two or more first hole portions is arranged outside relative to the piezoelectric element when viewed in the extending direction of the axial line.

25. A fluid control device provided with the pump according to claim 1.

* * * * *